US012781767B2

(12) United States Patent
Ueda et al.

(10) Patent No.: US 12,781,767 B2
(45) Date of Patent: Nov. 3, 2026

(54) METHOD FOR ASSEMBLING COMPRESSOR MODULE AND COMPRESSOR MODULE

(71) Applicant: MITSUBISHI HEAVY INDUSTRIES COMPRESSOR CORPORATION, Hiroshima (JP)

(72) Inventors: Hirohisa Ueda, Hiroshima (JP); Keita Nagaya, Hiroshima (JP); Hiroyuki Miyata, Hiroshima (JP)

(73) Assignee: MITSUBISHI HEAVY INDUSTRIES COMPRESSOR CORPORATION, Hiroshima (JP)

( * ) Notice: Subject to any disclaimer, the term of this patent is extended or adjusted under 35 U.S.C. 154(b) by 0 days.

(21) Appl. No.: 19/159,472

(22) PCT Filed: Feb. 9, 2024

(86) PCT No.: PCT/JP2024/004550
§ 371 (c)(1),
(2) Date: Aug. 25, 2025

(87) PCT Pub. No.: WO2024/181094
PCT Pub. Date: Sep. 6, 2024

(65) Prior Publication Data

US 2026/0243276 A1 Aug. 20, 2026

(30) Foreign Application Priority Data

Feb. 27, 2023 (JP) ..... 2023-027996

(51) Int. Cl.
*F04C 18/14* (2006.01)
*F01C 21/00* (2006.01)
(Continued)

(52) U.S. Cl.
CPC ..... *F04D 29/624* (2013.01); *F01C 21/007* (2013.01); *F04B 39/14* (2013.01);
(Continued)

(58) Field of Classification Search
CPC ..... F04C 18/14; F04C 29/04; F04C 2230/60; F04C 11/00; F04C 18/16; F04C 23/00;
(Continued)

(56) References Cited

U.S. PATENT DOCUMENTS 5,626,468 A * 5/1997 Muir ..... F04B 41/00 248/639
9,127,570 B2 * 9/2015 Nagao ..... F01D 25/28
(Continued)

FOREIGN PATENT DOCUMENTS

JP H09119385 A * 5/1997 ..... F04C 23/00
JP 6060045 B2 1/2017

OTHER PUBLICATIONS

International Search Report issued for corresponding international patent application No. PCT/JP2024/004550, mailed Mar. 5, 2024 (4 pages).

(Continued)

*Primary Examiner* — Dominick L Plakkoottam
(74) *Attorney, Agent, or Firm* — Osha Bergman Watanabe & Burton LLP

(57) ABSTRACT

A compressor module includes: a compressor that includes a rotor shaft rotating about an axis and can compress a fluid in stages; a gas supply device configured to supply a sealing gas to the compressor; a plurality of cooling units configured to cool the fluid compressed by the compressor; and a first support part supporting at least two of the cooling units from below in a vertical direction and formed in a rectangular parallelepiped shape by a plurality of column parts extending in the vertical direction and a plurality of beam parts extending in a first direction that is one of horizontal directions.

10 Claims, 24 Drawing Sheets

(51) Int. Cl.

| | |
|---|---|
| ***F04B 39/14*** | (2006.01) |
| ***F04C 23/00*** | (2006.01) |
| ***F04C 29/04*** | (2006.01) |
| ***F04D 17/10*** | (2006.01) |
| ***F04D 25/02*** | (2006.01) |
| ***F04D 29/62*** | (2006.01) |

(52) U.S. Cl.
CPC ..... *F04C 23/00* (2013.01); *F04C 29/04* (2013.01); *F04D 17/10* (2013.01); *F04D 25/02* (2013.01); *F04C 2230/60* (2013.01)

(58) Field of Classification Search
CPC ..... F04C 23/02; F04B 39/06; F04B 39/121; F04B 41/00; F04B 23/025; F04B 39/0044; F04B 39/0284; F04B 39/12; F04B 39/14; F04B 41/06; F01C 21/007

See application file for complete search history.

(56) References Cited

U.S. PATENT DOCUMENTS

| | | | | |
|---|---|---|---|---|
| 9,366,268 | B2 * | 6/2016 | Maier | F04B 39/12 |
| 10,247,453 | B2 * | 4/2019 | Sueda | F25B 31/02 |
| 2008/0112825 | A1 * | 5/2008 | Struck | F02C 7/36 417/423.14 |
| 2015/0000867 | A1 * | 1/2015 | Oba | F04B 41/00 165/68 |
| 2017/0159872 | A1 * | 6/2017 | Mistry | F01C 21/007 |
| 2017/0218958 | A1 * | 8/2017 | Seaver | F04C 29/04 |
| 2019/0162202 | A1 * | 5/2019 | Hayashi | F04D 17/10 |
| 2019/0331106 | A1 * | 10/2019 | Watanabe | F04D 29/063 |
| 2021/0285535 | A1 * | 9/2021 | Kodama | F16M 5/00 |
| 2022/0056899 | A1 * | 2/2022 | Kinoshita | F04B 39/121 |
| 2023/0272872 | A1 * | 8/2023 | Yamamoto | F16L 51/025 285/226 |

OTHER PUBLICATIONS

Written Opinion issued for corresponding international patent application No. PCT/JP2024/004550, mailed Mar. 5, 2024 (7 pages).

* cited by examiner

METHOD FOR ASSEMBLING COMPRESSOR MODULE AND COMPRESSOR MODULE

TECHNICAL FIELD

The present disclosure relates to a method for assembling a compressor module and the compressor module.

This application claims priority based on Japanese Patent Application No. 2023-027996 filed in Japan on Feb. 27, 2023, the contents of which are incorporated herein.

BACKGROUND ART

A compressor module, in which a compressor that compresses a gaseous body such as air or gas and a rotary drive machine such as a motor or a turbine that drives the compressor are installed on a base plate, is used in marine equipment such as a ship. In such a compressor module, a cooler that cools a fluid compressed by the compressor is also integrally provided.

For example, Patent Document 1 discloses a configuration including a compressor, a plurality of coolers, and a support base that supports the compressor and the plurality of coolers on an installation surface. The support base includes a main body support base that supports the compressor, and an accessory support base that supports the coolers. The main body support base and the accessory support base are disposed side by side in the horizontal direction.

CITATION LIST

Patent Literature

Patent Document 1: JP 6060045 B

SUMMARY OF INVENTION

Technical Problem

In the configuration as described in Patent Literature 1, however, the main body support base that supports the compressor and the accessory support base that supports the coolers are separately provided. In this case, in installing the main body support base and the accessory support base, a relative positional deviation may occur between the main body support base and the accessory support base. In order to absorb the relative positional deviation between the main body support base and the accessory support base, a flexible expansion pipe is used as piping connecting the compressor and the cooler. In order to absorb the relative positional deviation between the main body support base and the accessory support base, however, the expansion pipe is fixed to the compressor or the cooler in a deformed state. As a result, a reaction force due to the deformation may act on the compressor and the coolers from the expansion pipe, to adversely affect the compressor and the coolers. On the other hand, an effort to suppress the relative positional deviation between the main body support base and the accessory support base requires time and labor for adjusting the positions of the main body support base and the accessory support base at the installation site.

The present disclosure provides a method for assembling a compressor module that allows the compressor module to be efficiently assembled with high accuracy and the compressor module.

Solution to Problem

A method for assembling a compressor module according to the present disclosure is a method for assembling a compressor module including: a compressor that includes a rotor shaft rotating about an axis and can compress a fluid in stages; a gas supply device configured to supply a sealing gas to the compressor; a plurality of cooling units configured to cool the fluid compressed by the compressor; a first support part supporting at least two of the cooling units from below in a vertical direction and formed in a rectangular parallelepiped shape by a plurality of column parts extending in the vertical direction and a plurality of beam parts extending in a first direction that is one of horizontal directions; a second support part disposed spaced in the first direction from the first support part, supporting at least two of the cooling units different from those supported by the first support part from below in the vertical direction, and formed in a rectangular parallelepiped shape by the plurality of column parts extending in the vertical direction and the plurality of beam parts extending in the first direction; and a third support part fixed directly above the first support part in the vertical direction and supporting the compressor and the gas supply device from below in the vertical direction. The method includes: preparing a positioning member formed adjusted to an installation interval in the first direction between the first support part and the second support part in a state where the first support part and the second support part are fixed on an installation surface; fixing, on the installation surface, the first support part with the at least two of the cooling units fixed; disposing the second support part to which the at least two of the cooling units different from those supported by the first support part are being fixed in a movable state spaced in the first direction from the first support part; adjusting an interval between the first support part and the second support part in the first direction to the installation interval by using the positioning member and positioning the second support part with respect to the first support part on the installation surface in a second direction orthogonal to the first direction and the vertical direction and in the first direction, and fixing the second support part on the installation surface.

A compressor module according to the present disclosure includes: a compressor that includes a rotor shaft rotating about an axis and can compress a fluid in stages; a gas supply device configured to supply a sealing gas to the compressor; a plurality of cooling units configured to cool the fluid compressed by the compressor; a first support part supporting at least two of the cooling units from below in a vertical direction and formed in a rectangular parallelepiped shape by a plurality of column parts extending in the vertical direction and a plurality of beam parts extending in a first direction that is one of horizontal directions; a second support part disposed spaced in the first direction from the first support part, supporting at least two of the cooling units different from those supported by the first support part from below in the vertical direction, and formed in a rectangular parallelepiped shape by a plurality of column parts extending in the vertical direction and a plurality of beam parts extending in the first direction; a third support part fixed directly above the first support part in the vertical direction and supporting the compressor and the gas supply device from below in the vertical direction; a positioning member that is formed adjusted to an installation interval in the first direction between the first support part and the second support part with the first support part and the second support part fixed on an installation surface and is configured to determine relative positions of the second support part and the first support part in a second direction orthogonal to the first direction and the vertical direction and in the first direction.

Advantageous Effects of Invention

A method for assembling a compressor module and the compressor module according to the present disclosure allows the compressor module to be efficiently assembled with high accuracy.

DESCRIPTION OF EMBODIMENTS

First Embodiment

Figure 1:
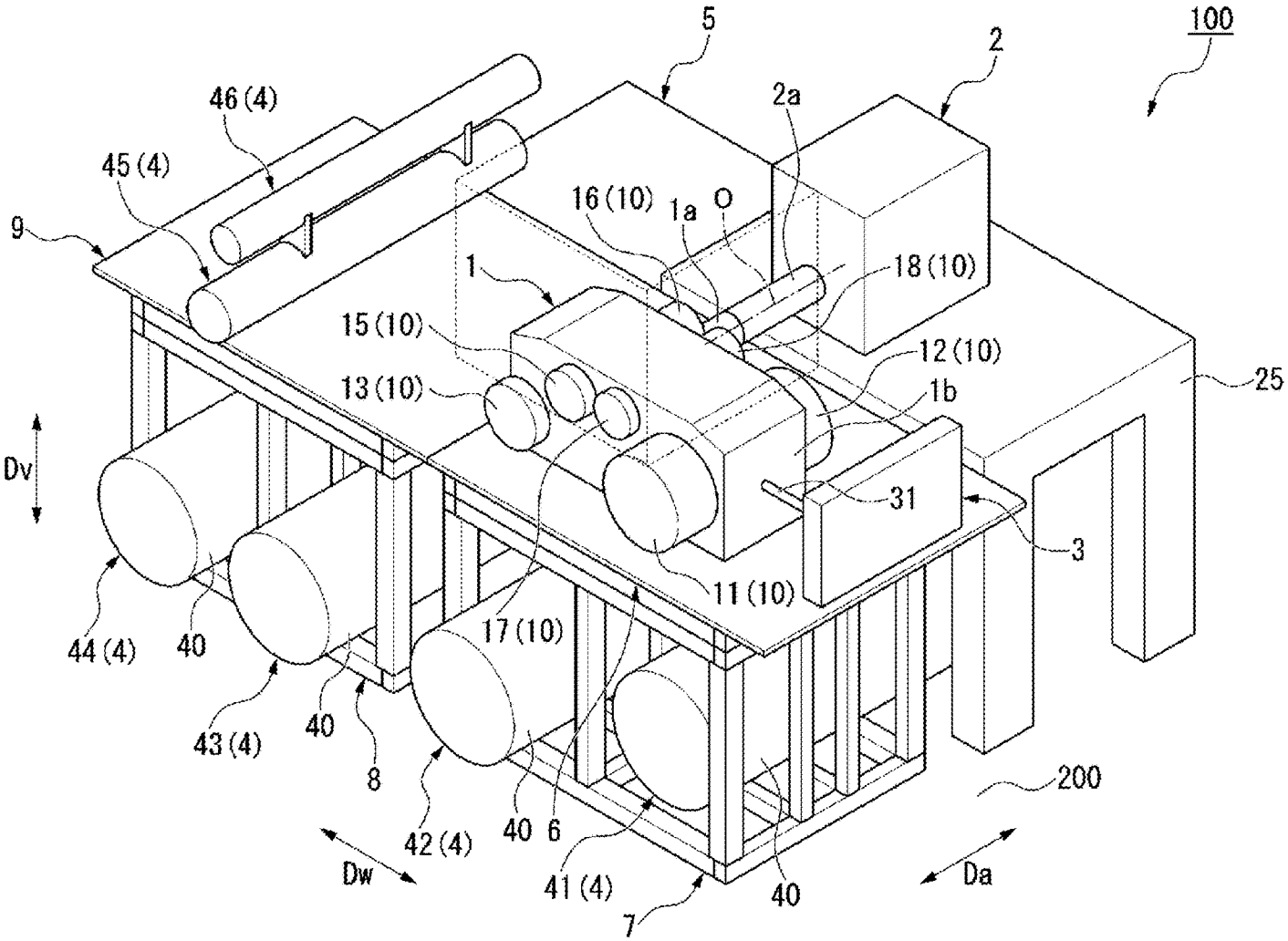
FIG. 1 is a perspective view illustrating a schematic configuration of a compressor module according to the present embodiment.

Hereinafter, a mode for implementing a method for assembling a compressor module and the compressor module according to the present disclosure will be described with reference to the accompanying drawings. However, the present disclosure is not limited only to these embodiments.

Configuration of Compressor Module

As illustrated in FIGS. 1 to 4, the compressor module 100 includes a compressor 1, a rotary drive machine 2, a gas supply device 3, a plurality of cooling units 4, an oil console device 5, a first support part 7, a second support part 8, a third support part 6, and a fourth support part 9.

Compressor

The compressor 1 compresses gas as working fluid. The compressor 1 includes a rotor shaft 1*a* rotating about an axis O. The rotor shaft 1*a* has a columnar shape centered on the axis O. The compressor 1 can compress gas (fluid) in stages. By including a plurality of compression units 10, the compressor 1 of the present embodiment can compress the gas in stages. The compressor 1 of the present embodiment is, for example, a geared compressor including eight-stage compression units 10. In the compressor 1, each of the compression units 10 includes one impeller (not illustrated).

The compressor 1 of the present embodiment further includes therein a gear casing 1*b* including a plurality of gears (not illustrated). The gear can transmit the rotation of the rotor shaft 1*a* to a plurality of driven shafts (not illustrated). The driven shaft has both ends at which the compression units 10 are disposed and extends in an axial direction Da in parallel with the rotor shaft 1*a*. The rotation speeds of the plurality of (four in the present embodiment) driven shafts are set to be different from one another by the plurality of gears. The rotor shaft 1*a* extends so as to protrude to the outside of the gear casing 1*b*.

In the following description, a direction in which an axis O of the rotor shaft 1*a* described later extends is the axial direction Da. The axial direction Da is one of horizontal directions. The horizontal direction is a direction in which a virtual plane orthogonal to a vertical direction Dv expands. One direction orthogonal to the axial direction Da in the horizontal direction is called a width direction Dw. In the present embodiment, the width direction Dw is a first direction which is one of the horizontal directions. The axial direction Da is a second direction which is one of the horizontal directions.

The plurality of compression units 10 are disposed outside the gear casing 1*b*. The compressor 1 of the present embodiment includes, as the compression units 10, a first compression unit 11, a second compression unit 12, a third compression unit 13, a fourth compression unit 14, a fifth compression unit 15, a sixth compression unit 16, a seventh compression unit 17, and an eighth compression unit 18.

The first compression unit 11 compresses a gas supplied from the outside of the compressor 1. The first compression unit 11 has the largest volume flow rate of the gas to be compressed among the plurality of compression units 10. The second compression unit 12 compresses the gas compressed by the first compression unit 11. The second compression unit 12 is rotated by the same driven shaft as that for the first compression unit 11. The volume flow rate of the gas compressed by the second compression unit 12 is smaller than that of the first compression unit 11.

The third compression unit 13 compresses the gas compressed by the second compression unit 12. The third compression unit 13 is rotated by a driven shaft different from that of the first compression unit 11 and the second compression unit 12. The volume flow rate of the gas compressed by the third compression unit 13 is smaller than that of the second compression unit 12. The fourth compression unit 14 compresses the gas compressed by the third compression unit 13. The fourth compression unit 14 is rotated by the same driven shaft as that for the third compression unit 13. The volume flow rate of the gas compressed by the fourth compression unit 14 is smaller than that of the third compression unit 13.

The fifth compression unit 15 compresses the gas compressed by the fourth compression unit 14. The fifth compression unit 15 is rotated by a driven shaft different from that of the third compression unit 13 and the fourth compression unit 14. The volume flow rate of the gas compressed by the fifth compression unit 15 is smaller than that of the fourth compression unit 14. The sixth compression unit 16 compresses the gas compressed by the fifth compression unit 15. The sixth compression unit 16 is rotated by the same driven shaft as that for the fifth compression unit 15. The volume flow rate of the gas compressed by the sixth compression unit 16 is smaller than that of the fifth compression unit 15.

The seventh compression unit 17 compresses the gas compressed by the sixth compression unit 16. The seventh compression unit 17 is rotated by a driven shaft different from that of the fifth compression unit 15 and the sixth compression unit 16. The volume flow rate of the gas compressed by the seventh compression unit 17 is smaller than that of the sixth compression unit 16. The eighth compression unit 18 compresses the gas compressed by the seventh compression unit 17. The eighth compression unit 18 is rotated by the same driven shaft as that for the seventh compression unit 17. The volume flow rate of the gas compressed by the eighth compression unit 18 is smaller than that of the seventh compression unit 17.

Rotary Drive Machine

The rotary drive machine 2 is coupled to the compressor 1. The rotary drive machine 2 drives the compressor 1. The rotary drive machine 2 includes an output shaft 2*a* that is rotationally driven. The rotary drive machine 2 of the present embodiment is, for example, an electric motor. The rotary drive machine 2 always rotates the output shaft 2*a* at a constant speed. The output shaft 2*a* is rotationally driven about the axis O. The output shaft 2*a* has a columnar shape centered on the axis O. The output shaft 2*a* is connected to the rotor shaft 1*a*. This causes the rotation of the output shaft 2*a* to be transmitted to the rotor shaft 1*a*. The rotary drive machine 2 is not limited to a structure directly connected to the compressor 1 and may be a structure indirectly connected via a transmission or the like. The rotary drive machine 2 is disposed side by side while being spaced from the compressor 1 in the axial direction Da.

The rotary drive machine 2 is disposed on a drive support part 25. The drive support part 25 supports the rotary drive machine 2 from below in the vertical direction Dv. The drive support part 25 is disposed so as to be next to the third support part 6 in the axial direction Da. The drive support part 25 is formed such that the position of the output shaft 2*a* of the rotary drive machine 2 and the position of the rotor shaft 1*a* of the compressor 1 are disposed at the same position (level) in the vertical direction Dv. The drive support part 25 is formed as a gate-shaped base formed of concrete higher in rigidity than the third support part 6 and the first support part 7, for example. The drive support part 25 is directly fixed to an installation surface 200. The installation surface 200 is formed in a predetermined shape with a preset dimensional accuracy. The drive support part 25 is disposed independently of the first support part 7, the second support part 8, the third support part 6, and the fourth support part 9.

Gas Supply Device

The gas supply device 3 can supply the compressor 1 with a sealing gas. The gas supply device 3 is connected to the compressor 1 by a plurality of pipes 31. The gas supply device 3 is disposed apart in the width direction Dw from the compressor 1. The gas supply device 3 of the present embodiment is a gas seal module (gas seal device: GSM). The gas supply device 3 is adjustable so that the pressure of the sealing gas is higher than that in the inside in order to prevent the sealing gas sent to a dry gas seal (not illustrated) disposed in the casing from flowing back at the dry gas seal.

Cooling Unit

The plurality of cooling units 4 cool the gas compressed by the compressor 1. The cooling units 4 are disposed one by one between the stages of the two compression units 10. The cooling unit 4 of the present embodiment is a shell-and-tube heat exchanger. That is, the cooling unit 4 includes a shell 40 having a tubular shape and a tube type heat exchanging unit (not illustrated) such as a cooling pipe disposed inside the shell 40. In the cooling unit 4, cooling water is used as a refrigerant. Each of the cooling units 4 cools the gas discharged from the compression unit 10 of the preceding stage and supplies the gas to the compression unit 10 of the following stage. The plurality of cooling units 4 of the present embodiment include a first cooling unit 41, a second cooling unit 42, a third cooling unit 43, a fourth cooling unit 44, a fifth cooling unit 45, and a sixth cooling unit 46.

The first cooling unit 41 cools the gas compressed by the first compression unit 11. The first cooling unit 41 can supply the cooled gas to the second compression unit 12.

Figure 2:
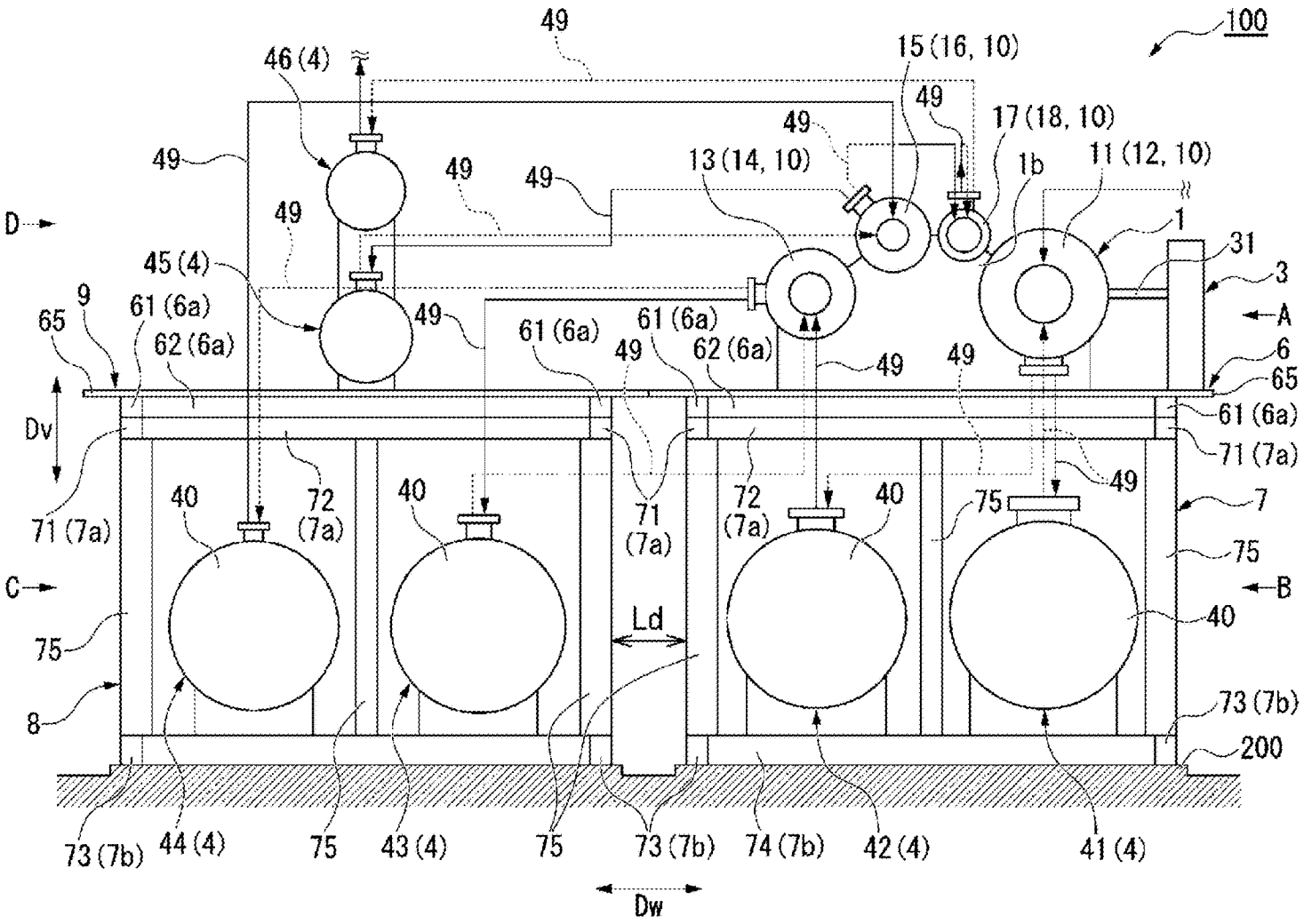
FIG. 2 is a front view of the compressor module of the present embodiment as viewed from the front in an axial direction.

The first cooling unit 41 is connected to the first compression unit 11 and the second compression unit 12 by an expansion joint 49 (see FIG. 2).

The second cooling unit 42 cools the gas compressed by the second compression unit 12. The second cooling unit 42 can supply the cooled gas to the third compression unit 13. The second cooling unit 42 is connected to the second compression unit 12 and the third compression unit 13 by the expansion joint 49 (see FIG. 2).

The third cooling unit 43 cools the gas compressed by the third compression unit 13. The third cooling unit 43 can supply the cooled gas to the fourth compression unit 14. The third cooling unit 43 is connected to the third compression unit 13 and the fourth compression unit 14 by the expansion joint 49 (see FIG. 2).

The fourth cooling unit 44 cools the gas compressed by the fourth compression unit 14. The fourth cooling unit 44 can supply the cooled gas to the fifth compression unit 15. The fourth cooling unit 44 is connected to the fourth compression unit 14 and the fifth compression unit 15 by the expansion joint 49 (see FIG. 2).

The fifth cooling unit 45 cools the gas compressed by the fifth compression unit 15. The fifth cooling unit 45 can supply the cooled gas to the sixth compression unit 16. The fifth cooling unit 45 is connected to the fifth compression unit 15 and the sixth compression unit 16 by piping and the expansion joint 49 (see FIG. 2).

The sixth cooling unit 46 cools the gas compressed by the eighth compression unit 18. The sixth cooling unit 46 is connected to the eighth compression unit 18 by piping and the expansion joint 49 (see FIG. 2). The sixth cooling unit 46 of the present embodiment is a recycle cooler that finally cools the gas having the highest pressure compressed by the compressor 1. The sixth cooling unit 46 can supply the cooled gas to a compression unit inlet inside the compressor module 100.

Oil Console Device

The oil console device 5 supplies lubricating oil to the compressor 1 and the rotary drive machine 2. The oil console device 5 is made up of a plurality of devices (not illustrated), such as a tank, a pump, an oil cooler, and an oil filter. The oil console device 5 is disposed at a position not overlapping the compressor 1 and the rotary drive machine 2 in the horizontal direction when viewed from the vertical direction Dv. The oil console device 5 is disposed below the compressor 1 and the rotary drive machine 2 in the vertical direction Dv. The oil console device 5 is fixed to the installation surface 200. That is, the oil console device is disposed independently of the first support part 7, the second support part 8, the third support part 6, the fourth support part 9, and the drive support part 25.

First Support Part to Fourth Support Part

Among the compressor 1, the rotary drive machine 2, the gas supply device 3, the plurality of cooling units 4, and the oil console device 5 constituting the compressor module 100 as described above, the compressor 1, the rotary drive machine 2, the gas supply device 3, and the plurality of cooling units 4 are supported by the first support part 7, the second support part 8, the third support part 6, and the fourth support part 9. Each of the first support part 7, the second support part 8, the third support part 6, and the fourth support part 9 is unitized so as to be transportable by a vehicle such as a ship or a truck, a crane, or the like. Each of the first support part 7, the second support part 8, the third support part 6, and the fourth support part 9 is transported from a factory to an installation site of the compressor module 100 in a state where at least a part thereof is assembled in the factory, and is installed on the installation surface 200 in the installation site.

First Support Part

Figure 4:
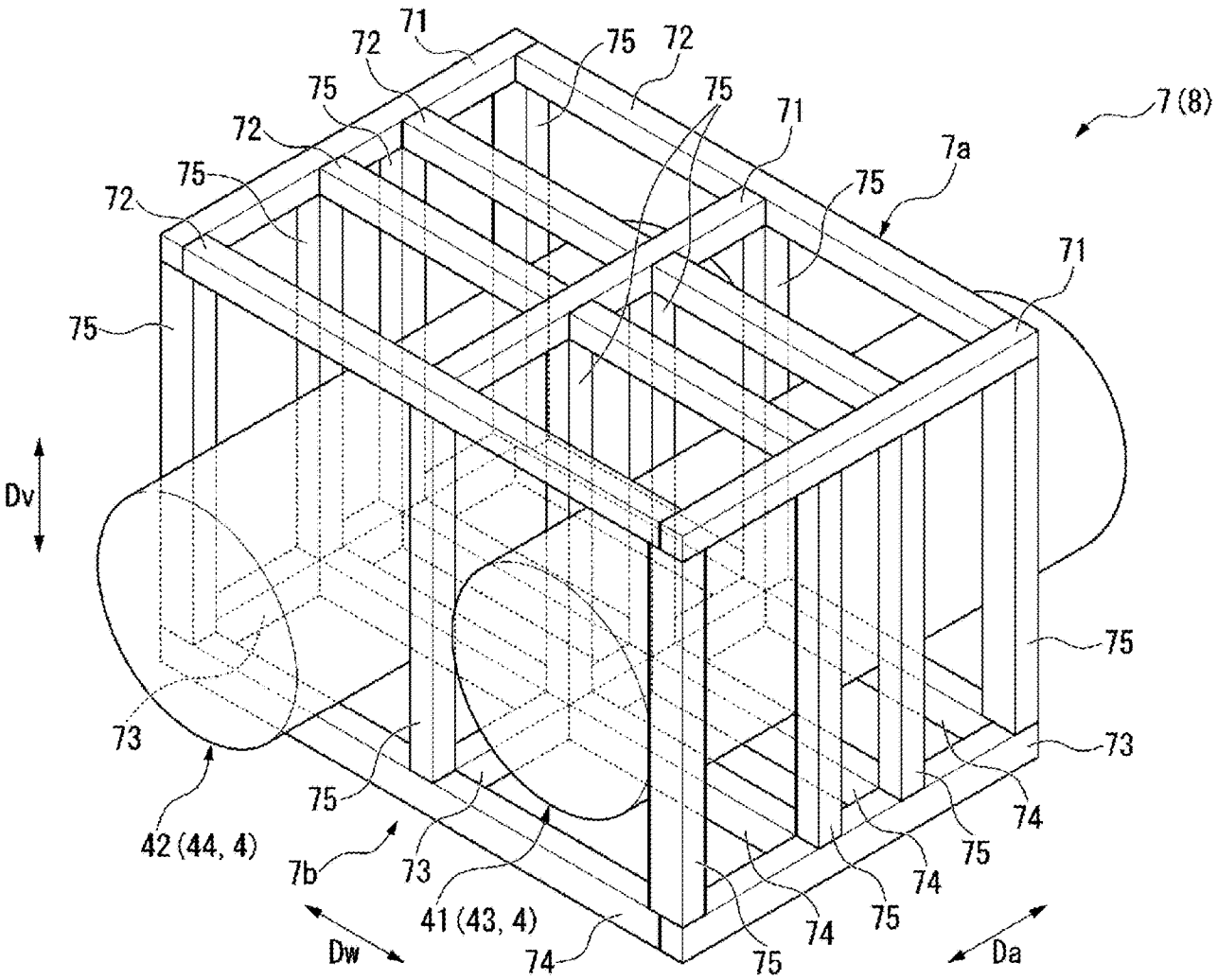
FIG. 4 is a perspective view illustrating a schematic configuration of a second support part.

The first support part 7 supports at least two cooling units 4 from below in the vertical direction Dv. The first support part 7 is transportable with the plurality of cooling units 4 fixed. The first cooling unit 41 and the second cooling unit 42 are fixed to the first support part 7 of the present embodiment. That is, the first support part 7 is transportable with the first cooling unit 41 and the second cooling unit 42 being fixed. The first support part 7 is fixed on the installation surface 200. The first support part 7 is fixed with the third support part 6. As illustrated in FIG. 4, the first support part 7 includes a first upper vertical beam part (beam part) 71, a first upper horizontal beam part (beam part) 72, a first lower vertical beam part (beam part) 73, a first lower horizontal beam part (beam part) 74, a column part 75, and a first fixed position P71 (see FIG. 11).

The first upper vertical beam part 71 is a member extending in the axial direction Da. A plurality of the first upper vertical beam parts 71 are disposed spaced in the width direction Dw. In the present embodiment, three first upper vertical beam parts 71 are disposed evenly apart in the width direction Dw. The first upper vertical beam part 71 is, for example, H-shaped steel.

The first upper horizontal beam part 72 is a member extending in the width direction Dw. A plurality of the first upper horizontal beam parts 72 are disposed spaced in the axial direction Da. In the present embodiment, four first upper horizontal beam parts 72 are disposed apart in the axial direction Da. The first upper horizontal beam part 72 is, for example, H-shaped steel. The first upper horizontal beam part 72 is fixed to the first upper vertical beam part 71. A first upper frame body **7*a* having a rectangular shape is made up of the two first upper vertical beam parts 71 disposed outermost in the width direction Dw and the first upper horizontal beam parts 72 disposed outermost in the axial direction Da. That is, the first upper frame body 7*a* is formed in a rectangular annular shape with a hollow inside when viewed from above in the vertical direction Dv. The first upper frame body 7*a* is disposed above and away from the first cooling unit 41 and the second cooling unit 42** in the vertical direction Dv.

The first lower vertical beam part 73 is a member extending in the axial direction Da. A plurality of the first lower vertical beam parts 73 are disposed spaced in the width direction Dw. In the present embodiment, three first lower vertical beam parts 73 are disposed evenly apart in the width direction Dw. The first lower vertical beam part 73 is, for example, H-shaped steel. The first lower vertical beam part 73 is formed in the same shape as that of the first upper vertical beam part 71. The plurality of first lower vertical beam parts 73 are disposed at the same positions as those of the plurality of first upper vertical beam parts 71 when viewed from above in the vertical direction Dv.

The first lower horizontal beam part 74 is a member extending in the width direction Dw. A plurality of the first lower horizontal beam parts 74 are disposed spaced in the axial direction Da. In the present embodiment, four first lower horizontal beam parts 74 are disposed apart in the axial direction Da. The first lower horizontal beam part 74 is, for example, H-shaped steel. The first lower horizontal beam part 74 is formed in the same shape as that of the first upper horizontal beam part 72. The plurality of first lower horizontal beam parts 74 are disposed at the same positions as those of the plurality of first upper horizontal beam parts 72 when viewed from above in the vertical direction Dv. The first lower horizontal beam part 74 is fixed to the first lower vertical beam part 73. A first lower frame body 7*b* having a rectangular shape is made up of the two first lower vertical beam parts 73 disposed outermost in the width direction Dw and the first lower horizontal beam part 74 disposed outermost in the axial direction Da. That is, the first lower frame body 7*b* is formed in a rectangular shape with a hollow inside when viewed from above in the vertical direction Dv. The first lower frame body 7*b* is formed in the same shape as that of the first upper frame body 7*a*. The first lower frame body 7*b* is directly fixed to an installation surface 200. The first lower frame body 7*b* is fixed below the first cooling unit 41 and the second cooling unit 42 in the vertical direction Dv.

The column part 75 is a columnar member extending in the vertical direction Dv. The plurality of column parts 75 are disposed spaced in the horizontal direction (the width direction Dw and the axial direction Da). At least one of the plurality of column parts 75 is disposed between the first cooling unit 41 and the second cooling unit 42 in the horizontal direction and at a position overlapping the compressor 1 when viewed from the direction in which the axis O extends. In the present embodiment, three sets of four column parts 75 disposed apart in the axial direction Da are disposed apart in the width direction Dw. The four column parts 75 disposed apart in the axial direction Da are disposed at positions overlapping the plurality of first upper vertical beam parts 71 and first lower vertical beam parts 73 when viewed from above in the vertical direction Dv. The three column parts 75 disposed apart in the width direction Dw are disposed at positions overlapping the plurality of first upper horizontal beam parts 72 and the plurality of first lower horizontal beam parts 74 when viewed from above in the vertical direction Dv. The column part 75 that is the middle one of the three column parts 75 disposed apart in the width direction Dw is disposed between the first cooling unit 41 and the second cooling unit 42 in the width direction Dw. The two column parts 75 that are the middle two of the four column parts 75 disposed apart in the axial direction Da, the two column parts 75 disposed at the center in the width direction Dw are disposed at positions overlapping the gear casing 1*b* when viewed from above in the vertical direction Dv. The column part 75 is, for example, H-shaped steel. Both ends of the plurality of column parts 75 are fixed to the first upper frame body 7*a* and the first lower frame body 7*b*, respectively.

In this manner, the first support part 7 has a Rahmen structure formed in a rectangular shape by the plurality of column parts 75, the first upper frame body 7*a*, and the first lower frame body 7*b*. That is, the Rahmen structure is formed by the plurality of column parts 75 extending in the vertical direction Dv, the plurality of first upper vertical beam parts 71 and first lower vertical beam parts 73 extending in the axial direction Da, which is one of the horizontal directions, and the plurality of first upper horizontal beam parts 72 and first lower horizontal beam parts 74 extending in the width direction Dw, which is one of the horizontal directions. The Rahmen structure in the present embodiment also includes a structure reinforced by a brace in addition to the above-described members.

The first cooling unit 41 and the second cooling unit 42 are fixed to a space inside the first support part 7 formed by the Rahmen structure. As illustrated in FIGS. 1 to 4, the first support part 7 constitutes a first unit B together with the first cooling unit 41 and the second cooling unit 42. In the first unit B, all components are simultaneously transportable by a transport machine such as a crane.

Figure 11:
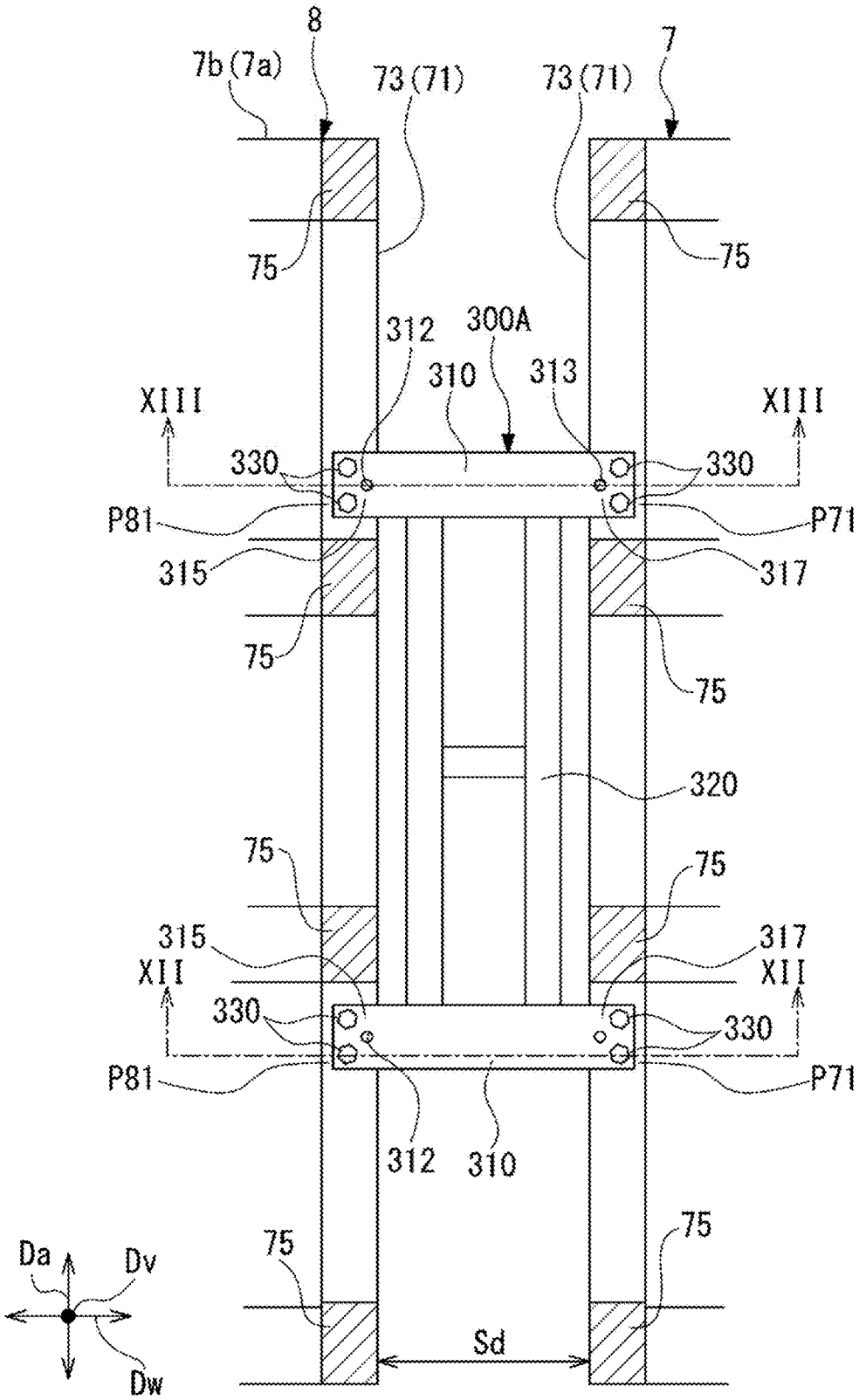
FIG. 11 is a plan view illustrating a state in which a positioning member is formed adjusted to a temporary installation interval between the first support part and the second support part fixed on the temporary installation surface.

As illustrated in FIG. 11, a positioning member 300A, which will be described later, can be held at the first fixed position P71. The first fixed position P71 is formed in at least one of the column part or the beam part. Specifically, the first fixed position P71 is formed in at least one of the first upper vertical beam part 71, the first upper horizontal beam part 72, the first lower vertical beam part 73, the first lower horizontal beam part 74, and the column part 75. The first fixed position P71 of the present embodiment is formed in each of the first upper vertical beam part 71 and the first lower vertical beam part 73.

Second Support Part

As illustrated in FIG. 2, the second support part 8 is disposed adjacent to the first support part 7 in the width direction Dw. The second support part 8 supports at least two cooling units 4 different from the first support part 7 from below in the vertical direction Dv. The third cooling unit 43 and the fourth cooling unit 44 are fixed to the second support part 8 of the present embodiment. The second support part 8 is transportable with the third cooling unit 43 and the fourth cooling unit 44 being fixed. The second support part 8 is formed to have the same structure as that of the first support part 7. That is, similarly to the second support part 8, the first support part 7 also has a Rahmen structure formed in a rectangular shape by the plurality of column parts 75 extending in the vertical direction Dv and the plurality of beam parts extending in the horizontal direction. Therefore, similarly to the first support part 7, the second support part 8 includes the first upper vertical beam part 71, the first upper horizontal beam part 72, the first lower vertical beam part 73, the first lower horizontal beam part 74, the column part 75. and a second fixed position P81 (see FIG. 11). In the second support part 8, the column part 75 that is the middle one of the three column parts 75 disposed apart in the width direction Dw is disposed between the third cooling unit 43 and the fourth cooling unit 44 in the width direction Dw. Furthermore, the column part 75 that is the middle one is disposed at a position overlapping the fifth cooling unit 45 and the sixth cooling unit 46 when viewed from above in the vertical direction Dv.

The third cooling unit 43 and the fourth cooling unit 44 are fixed to a space inside the second support part 8 formed by the Rahmen structure. The second support part 8 constitutes a second unit C together with the third cooling unit 43 and the fourth cooling unit 44. In the second unit C, all components are simultaneously transportable by a transport machine such as a crane.

As illustrated in FIG. 11, the positioning member 300A, which will be described later, can be held at the second fixed position P81. The second fixed position P81 is formed in at least one of the column part or the beam part. Specifically, the second fixed position P81 is formed in at least one of the first upper vertical beam part 71, the first upper horizontal beam part 72, the first lower vertical beam part 73, the first lower horizontal beam part 74, and the column part 75. The second fixed position P81 of the present embodiment is formed in each of the first upper vertical beam part 71 and the first lower vertical beam part 73.

Third Support Part

Figure 3:
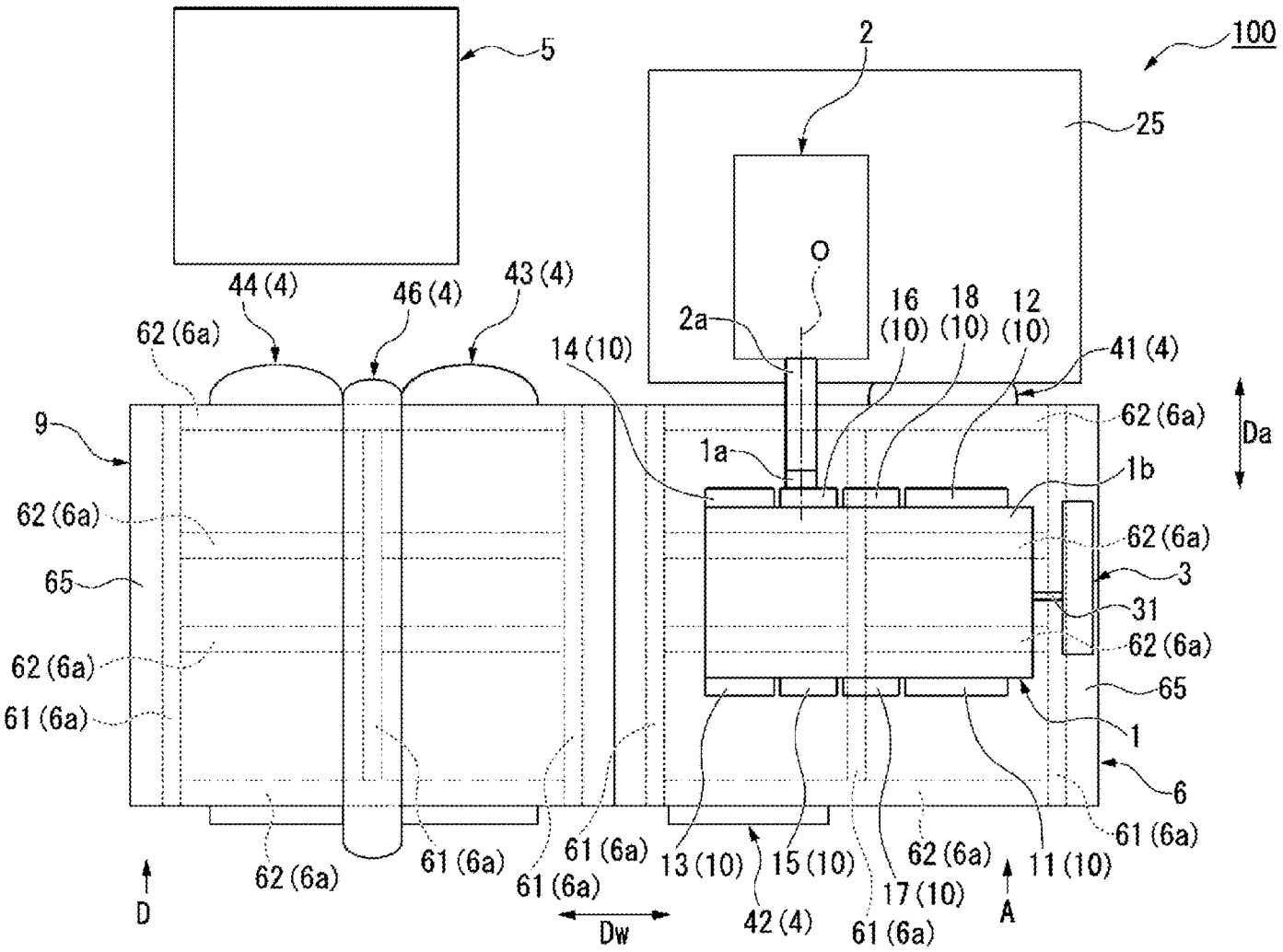
FIG. 3 is a top view of the compressor module of the present embodiment as viewed from above in a vertical direction.

As illustrated in FIG. 2, the third support part 6 supports the compressor 1 and the gas supply device 3 from below in the vertical direction Dv orthogonal to the horizontal direction. The third support part 6 is transportable with the compressor 1 and the gas supply device 3 connected by the plurality of pipes 31 being fixed. That is, the compressor 1 and the gas supply device 3 are fixed on the third support part 6. The third support part 6 is disposed directly above the first support part 7. The third support part 6 is fixed to the first support part 7. As illustrated in FIG. 3, the third support part 6 of the present embodiment includes a plurality of third vertical beam parts 61, a plurality of third horizontal beam parts 62, and a base plate body 65.

The third vertical beam part 61 is a columnar member extending in the axial direction Da. A plurality of the third vertical beam parts 61 are disposed spaced in the width direction Dw. In the present embodiment, three third vertical beam parts 61 are disposed evenly apart in the width direction Dw. The third vertical beam part 61 is, for example, H-shaped steel.

The third horizontal beam part 62 is a columnar member extending in the width direction Dw. The plurality of third horizontal beam parts 62 are disposed spaced in the axial direction Da. In the present embodiment, four third horizontal beam parts 62 are disposed apart in the axial direction Da. The third horizontal beam parts 62 is, for example, H-shaped steel. The third horizontal beam parts 62 is fixed to the third vertical beam parts 61. A third frame body 6*a* having a rectangular shape is made up of the two third vertical beam parts 61 disposed outermost in the width direction Dw and the third horizontal beam part 62 disposed outermost in the axial direction Da. That is, the third frame body 6*a* is formed in a rectangular shape with a hollow inside when viewed from above in the vertical direction Dv. In the third frame body 6*a*, the two third horizontal beam parts 62 disposed near the center in the axial direction Da are disposed at positions overlapping the compressor 1 and the gas supply device 3 when viewed from the vertical direction Dv. The third frame body 6*a* is directly fixed to the first upper frame body 7*a*.

The base plate body 65 expands in the axial direction Da and the width direction Dw. The base plate body 65 of the present embodiment is a flat plate member having a rectangular shape including a large surface expanding in the horizontal direction. The base plate body 65 is disposed above the third frame body 6*a* in the vertical direction Dv. The base plate body 65 is fixed to the third frame body 6*a*. When viewed from above in the vertical direction Dv, the base plate body 65 is formed to have a size overlapping with the entire region of the plurality of third vertical beam parts 61 and the plurality of third horizontal beam parts 62. The base plate body 65 of the present embodiment is formed in a rectangular shape in which the length in the axial direction Da is equal to that of the third frame body 6*a* and the length in the width direction Dw is larger than that of the third frame body 6*a* when viewed from above in the vertical direction Dv. The base plate body 65 is not deformed even when a lightweight object such as a worker is placed thereon. The compressor 1 and the gas supply device 3 are fixed to the base plate body 65 of the third support part 6.

As illustrated in FIGS. 1 to 4, the third support part 6 constitutes a third unit A together with the compressor 1 and the gas supply device 3. In the third unit A, all components are simultaneously transportable by a transport machine such as a crane.

Fourth Support Part

As illustrated in FIG. 2, the fourth support part 9 is disposed above the second support part 8 in the vertical direction Dv, adjacent to the third support part 6 in the width direction Dw. The fourth support part 9 is fixed to the second support part 8. The fourth support part 9 supports at least two cooling units 4 different from the first support part 7 and the second support part 8 from below in the vertical direction Dv. The fifth cooling unit 45 and the sixth cooling unit 46 are fixed to the fourth support part 9 of the present embodiment. The fourth support part 9 is transportable with the fifth cooling unit 45 and the sixth cooling unit 46 being fixed. The fourth support part 9 is formed to have the same structure as that of the third support part 6. Therefore, similarly to the third support part 6, the fourth support part 9 also includes the plurality of third vertical beam parts 61, the plurality of third horizontal beam parts 62, and the base plate body 65. The fifth cooling unit 45 is fixed to the base plate body 65 of the fourth support part 9.

The fourth support part 9 constitutes a fourth unit D together with the fifth cooling unit 45 and the sixth cooling unit 46. In the fourth unit D, all components are simultaneously transportable by a transport machine such as a crane.

Procedure of Method for Assembling Compressor Module

Figure 5:
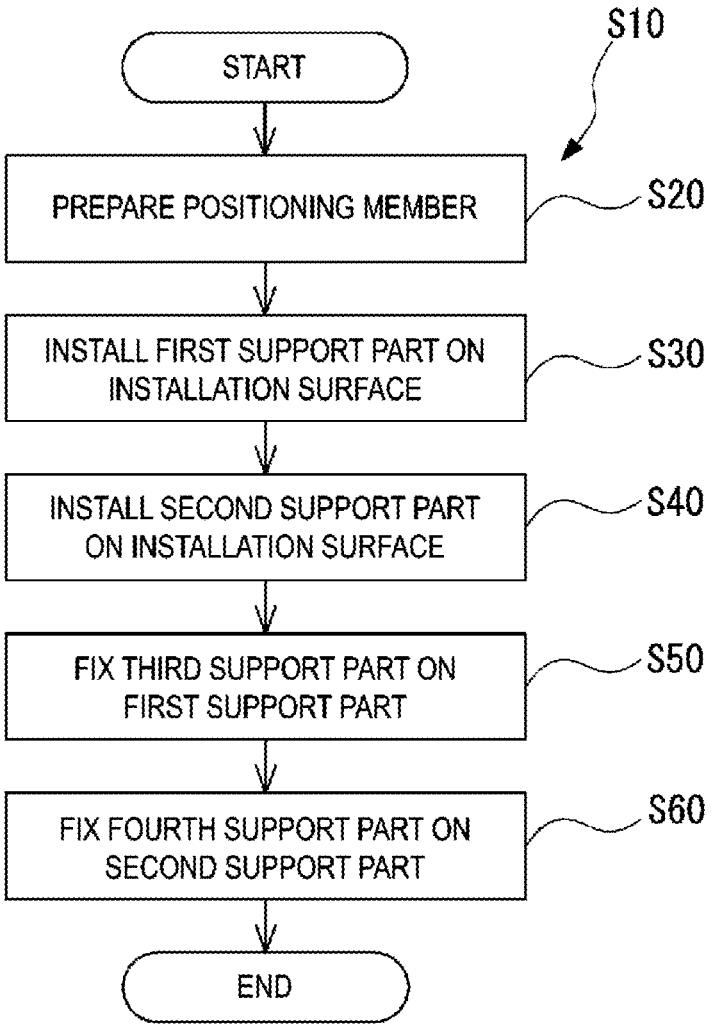
FIG. 5 is a flowchart illustrating a flow of a method for assembling the compressor module according to the present embodiment.

A method S10 for assembling the compressor module 100 includes adjusting the positions of the first unit B, the second unit C, the third unit A, and the fourth unit D using the positioning member 300A, and assembling the compressor module 100 on the installation surface 200. As illustrated in FIG. 5, the method S10 for assembling the compressor module 100 of the present embodiment includes a process S20 for preparing the positioning member 300A, a process S30 for installing the first support part 7 on the installation surface 200, a process S40 for installing the second support part 8 on the installation surface 200, a process S50 for fixing of fixing the third support part 6 on the first support part 7, and a process S60 for fixing the fourth support part 9 on the second support part 8.

Process for Preparing Position Determining Member

Figure 6:
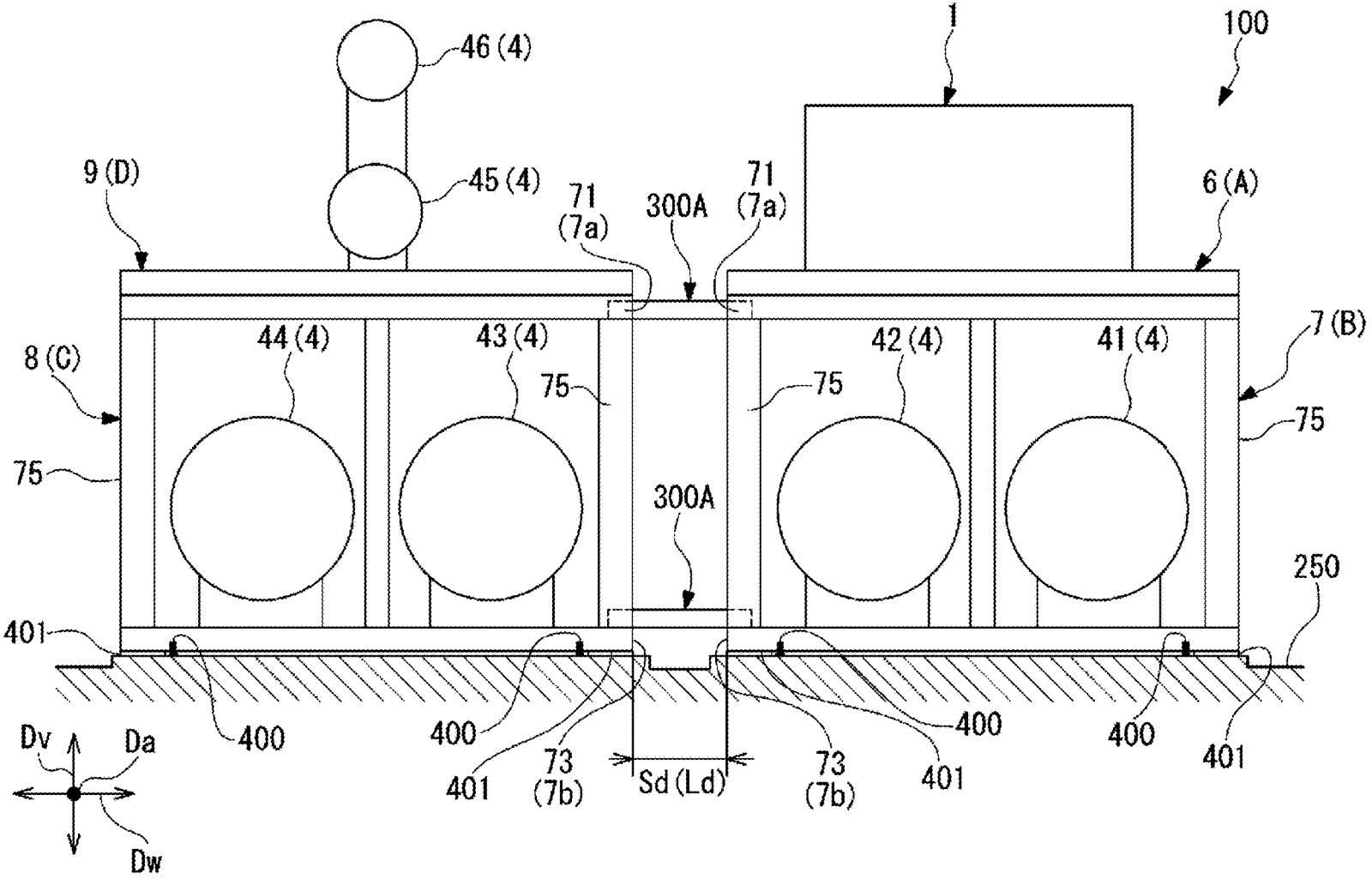
FIG. 6 is a diagram schematically illustrating a state where the compressor module is installed on a temporary installation surface and a positioning member is formed.

The process S20 for preparing the positioning member 300A includes preparing the positioning member 300A in advance, that is, before the compressor module 100 is assembled on the installation surface 200. As illustrated in FIG. 6, the positioning member 300A determines the relative positions of (positions) the first support part 7 and the second support part 8 in the horizontal direction. The positioning member 300A is formed adjusted to an installation interval Ld in the width direction Dw between the first support part 7 and the second support part 8 in a state where the first support part 7 and the second support part 8 are fixed on the installation surface 200. The positioning member 300A is a jig, and at least one such jig is disposed on the compressor module 100. The positioning member 300A may be in a state of being attached to the completed compressor module 100 or may be detached therefrom.

The process S20 for preparing the positioning member 300A according to the present embodiment is performed on a temporary installation surface 250 set at another location different from the installation surface 200 where the compressor module 100 is actually installed. The temporary installation surface 250 is set at another location different from the installation surface 200 where the compressor module 100 is installed and operated. The temporary installation surface 250 is, for example, a floor surface of a factory or the like. The temporary installation surface 250 is formed as an imitation of the installation surface 200 based on the design dimensions of the installation surface 200 on which the compressor module 100 is actually installed. In the process S20, the first support part 7 and the second support part 8 are fixed on the temporary installation surface 250 at an interval in the width direction Dw. Here, the interval between the first support part 7 and the second support part 8 on the temporary installation surface 250 in the width direction Dw is set based on the design dimensions of the compressor module 100. In the process S20, the compressor module 100 is temporarily assembled on the temporary installation surface 250. In the process S20, the positioning member 300A is prepared by being adjusted to the installation interval Ld between the first support part 7 and the second support part 8 in the compressor module 100 temporarily assembled on the temporary installation surface 250.

Figure 7:
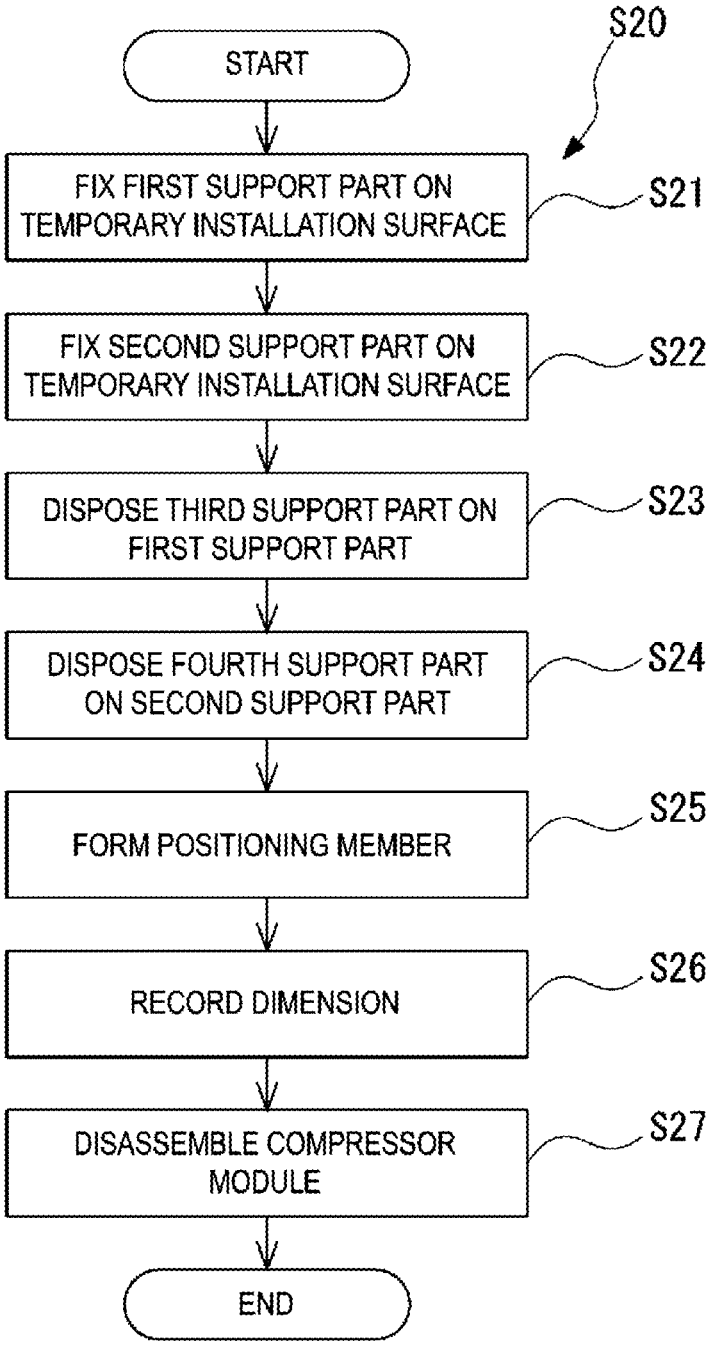
FIG. 7 is a diagram illustrating a flow of a process for preparing the positioning member.

As illustrated in FIG. 7, the process S20 for preparing the positioning member 300A of the present embodiment includes a process S21 for fixing the first support part 7 on the temporary installation surface 250, a process S22 for fixing the second support part 8 on the temporary installation surface 250, a process S23 for disposing the third support part 6 on the first support part 7, a process S24 for disposing the fourth support part 9 on the second support part 8, a process S25 for forming the positioning member 300A, a process S26 for recording dimensions, and a process S27 for disassembling the compressor module 100.

Figure 8:
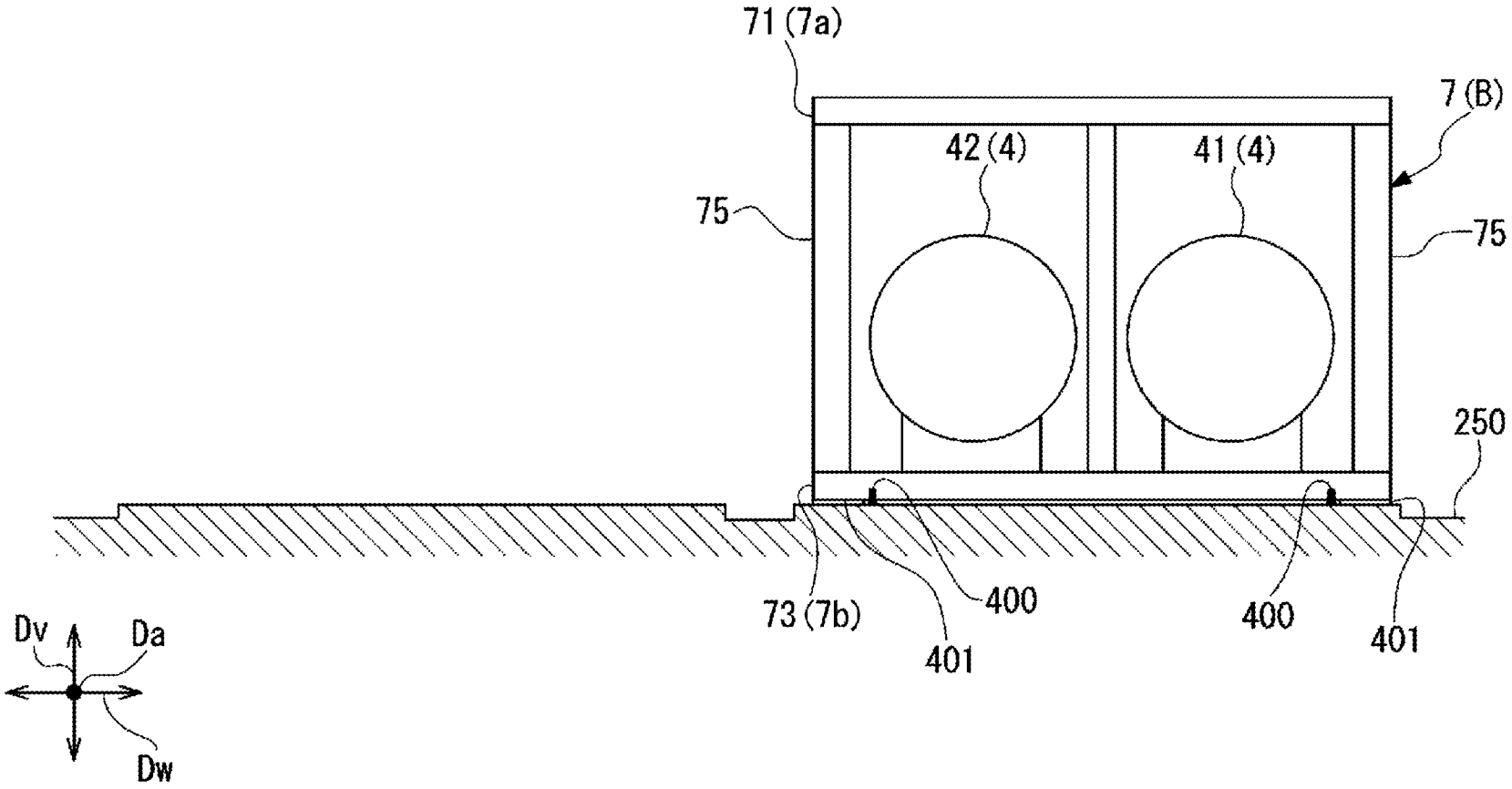
FIG. 8 is a diagram illustrating a state in which a first support part is fixed to the temporary installation surface.

In the process S21 for fixing the first support part 7 on the temporary installation surface 250, as illustrated in FIG. 8, the first support part 7 is installed on the temporary installation surface 250. First, the first support part 7 is assembled on the temporary installation surface 250. The first support part 7 is installed at a predetermined position on the temporary installation surface 250 while being adjusted to a marking line (not illustrated) drawn in advance based on the design dimension. The first cooling unit 41 and the second cooling unit 42 are incorporated in the first support part 7. The first cooling unit 41 and the second cooling unit 42 may be incorporated in the process for assembling the first support part 7, or may be incorporated after the first support part 7 is completed. In addition, piping and instrument connected to the first cooling unit 41 and the second cooling unit 42 are incorporated in the first support part 7. At this time, the piping connected to the other parts, that is, the second support part 8, the third support part 6, and the fourth support part 9 extending outward from the first support part 7 are not incorporated. In this manner, the first unit B is installed on the temporary installation surface 250. In the process S21, when the first support part 7 is installed, a shim 401 is interposed between the first support part 7 and the temporary installation surface 250, and the height, the horizontality, and the like of the first support part 7 with respect to the temporary installation surface 250 are adjusted. Thereafter, the first unit B is fixed to the temporary installation surface 250 in an immovable state by using a bolt 400 which is a fastening member attachable to and detachable from the first support part 7.

Figure 9:
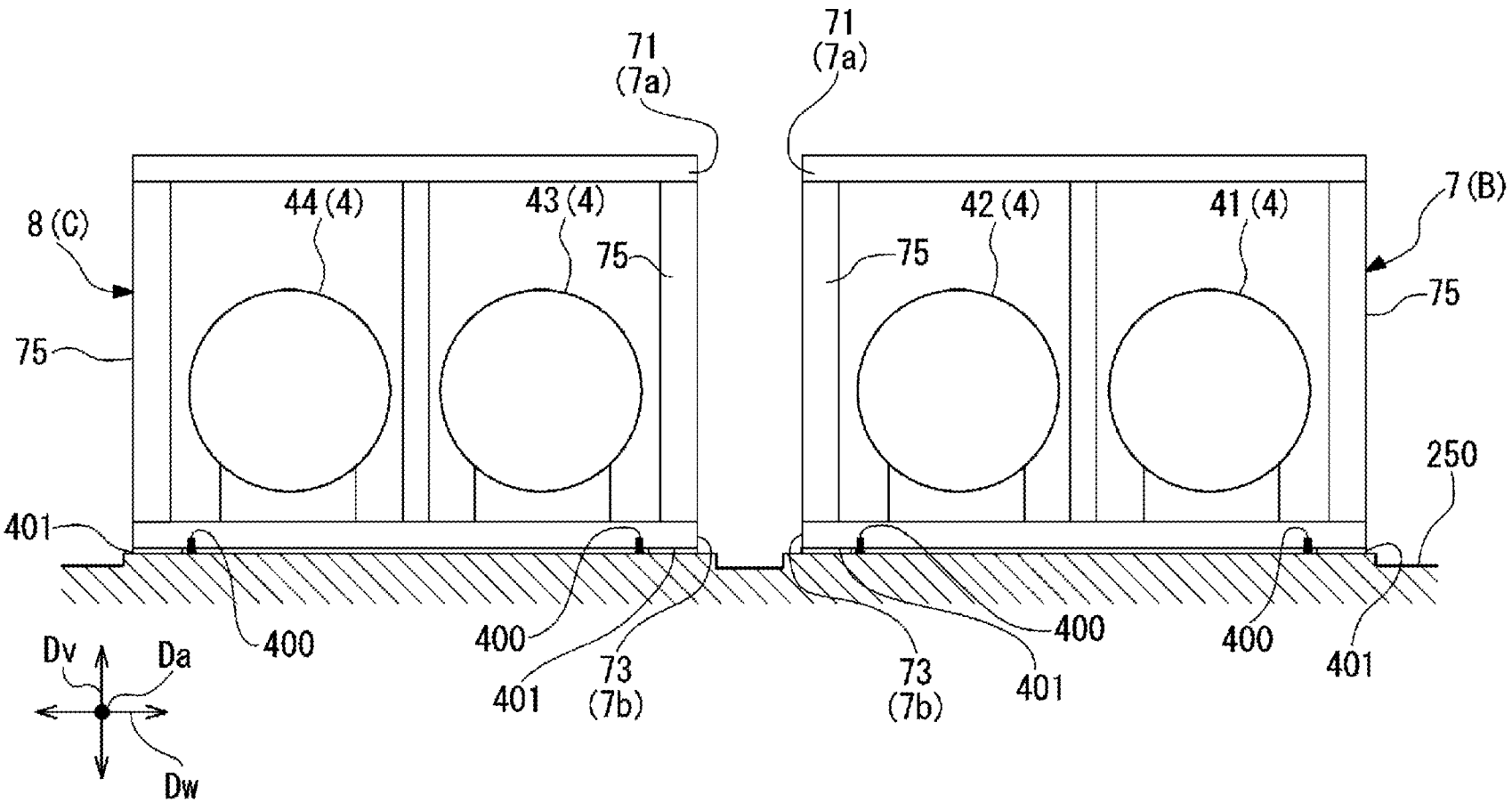
FIG. 9 is a diagram illustrating a state in which the second support part is fixed to the temporary installation surface.

In the process S22 for fixing the second support part 8 on the temporary installation surface 250, as illustrated in FIG. 9, the second support part 8 is installed on the temporary installation surface 250 at a predetermined interval, based on the design dimension in the width direction Dw, from the first support part 7. First, the second support part 8 is assembled on the temporary installation surface 250. The second support part 8 is installed on the temporary installation surface 250 while being adjusted to a marking line (not illustrated) drawn in advance based on the design dimension such that a predetermined interval based on the design dimension is provided as the interval with respect to the first support part 7 in the width direction Dw. As a result, the position of the second support part 8 with respect to the first support part 7 on the temporary installation surface 250 is determined. The third cooling unit 43 and the fourth cooling unit 44 are incorporated in the second support part 8. The third cooling unit 43 and the fourth cooling unit 44 may be incorporated in the process for assembling the second support part 8, or may be incorporated after the second support part 8 is completed. In addition, piping and instruments connected to the third cooling unit 43 and the fourth cooling unit 44 are incorporated in the second support part 8. At this time, the piping extending outward from the second support part 8 is not incorporated. In this manner, the second unit C is installed on the temporary installation surface 250. In the process S22, when the second support part 8 is installed, the shim 401 is interposed between the second support part 8 and the temporary installation surface 250, and the height, the horizontality, and the like of the second support part 8 with respect to the temporary installation surface 250 are adjusted. Thereafter, the second unit C is fixed to the temporary installation surface 250 in an immovable state by using the bolt 400 which is a fastening member attachable to and detachable from the second support part 8. Thus, in the process S22, after the position of the second support part 8 with respect to the first support part 7 on the temporary installation surface 250 is determined, the second support part 8 is fixed on the temporary installation surface 250.

Figure 10:
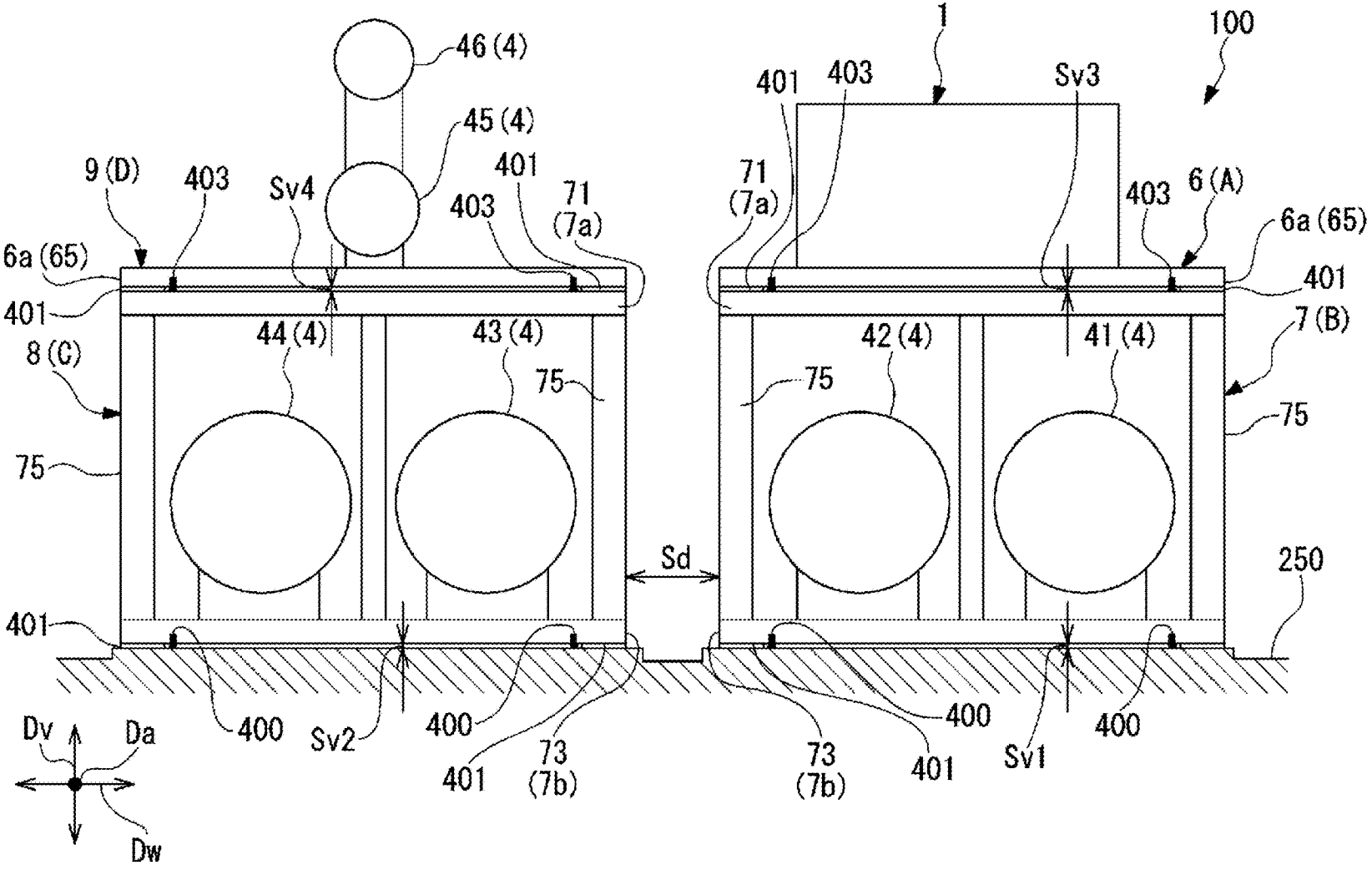
FIG. 10 is a diagram illustrating a state in which a third support part is disposed on the first support part and a fourth support part is disposed on the second support part.

In the process S23 for disposing the third support part 6 on the first support part 7, as illustrated in FIG. 10, the third support part 6 is disposed directly above the first support part 7. The third support part 6 may be assembled on the first support part 7, or the third frame body 6*a* assembled in advance at another location may be disposed on the first support part 7. The position of the third support part 6 is determined with respect to the first support part 7 based on a marking line drawn on the first support part 7. Accordingly, the position of the third support part 6 with respect to the first support part 7 is determined. The base plate body 65, the compressor 1, and the gas supply device 3 (see FIG. 1) are attached on the third frame body 6*a*. Instead of the base plate body 65, the compressor 1, and the gas supply device 3, a dummy base plate body, a dummy compressor, and a dummy gas supply device as imitations of these may be attached. The dummy base plate body, the dummy compressor, and the dummy gas supply device are, for example, box shaped members whose outer shapes are the same as those of the base plate body 65, the compressor 1, and the gas supply device 3. In the process S23, when the third support part 6 is installed, a height adjustment bolt 403 is attached to the third frame body 6*a* to adjust the height, the horizontality, and the like of the first support part 7 in the vertical direction Dv with respect to the first upper frame body 7*a*. After the adjustment, the shim 401 is interposed between the third support part 6 and the first support part 7. Thereafter, the third unit A is fixed on the first support part 7 in an immovable state using a bolt (not illustrated) which is a fastening member attachable to and detachable from the third support part 6. Thus, the third support part 6 is disposed on the first support part 7 with the position of the third support part 6 determined with respect to the first support part 7.

In the process S24 for disposing the fourth support part 9 on the second support part 8, the fourth support part 9 is disposed directly above the second support part 8. The fourth support part 9 may be assembled on the second support part 8, or the third frame body 6*a* assembled in advance at another location may be disposed on the second support part 8. The position of the fourth support part 9 is determined with respect to the second support part 8 based on a marking line drawn on the second support part 8. Accordingly, the position of the fourth support part 9 with respect to the second support part 8 is determined. The fifth cooling unit 45 and the sixth cooling unit 46 are attached on the third frame body 6*a*. In the process S24, when the fourth support part 9 is installed, the height adjustment bolt 403 is attached to the fourth support part 9 to adjust the height, the horizontality, and the like of the second support part 8 in the vertical direction Dv with respect to the first upper frame body 7*a*. After the adjustment, the shim 401 is interposed between the fourth support part 9 and the second support part 8. Thereafter, the fourth unit D is fixed on the second support part 8 in an immovable state by using a bolt (not illustrated) which is a fastening member attachable to and detachable from the fourth support part 9. Thus, the fourth support part 9 is disposed on the second support part 8 in a state where the fourth support part 9 is positioned with respect to the second support part 8. Thus, the compressor module 100 is temporarily assembled at an accurate position on the temporary installation surface 250.

In the process S25 for forming the positioning member 300A, as illustrated in FIG. 11, the positioning member 300A is formed adjusted to a temporary installation interval Sd between the first support part 7 and the second support part 8 temporarily assembled on the temporary installation surface 250. The temporary installation interval Sd is an interval in the width direction Dw between the first support part 7 and the second support part 8 fixed on the temporary installation surface 250. That is, through the processes S21 to S24, the positioning member 300A is formed with the temporary installation interval Sd regarded as the installation interval Ld. In the present embodiment, the positioning member 300A is disposed, for example, at each of the lower end portions and the upper end portions of the first support part 7 and the second support part 8. The positioning member 300A may be disposed at only at least one of the lower end portions or the upper end portions of the first support part 7 and the second support part 8. In this case, the positioning member 300A is preferably disposed at the lower end portions of the first support part 7 and the second support part 8. The positioning members 300A respectively disposed at the lower end portions and the upper end portions of the first support part 7 and the second support part 8 in the present embodiment have the same configuration.

The positioning member 300A includes a plurality of (two in the present embodiment) first members 310 and a coupling member 320. The positioning member 300A is formed of, for example, H-shaped steel, square steel pipes, or the like. In the present embodiment, the plurality of first members 310 are disposed at an equal interval in the axial direction Da as a pair. The first members 310 each extend in the width direction Dw. The coupling member 320 couples the plurality of first members 310 to each other. The coupling member 320 is formed in, for example, an H shape when viewed from the vertical direction Dv.

The positioning member 300A includes a first position determination part 317 and a second position determination part 315. The first position determination part 317 is immovable in the width direction Dw and the axial direction Da with respect to the first support part 7, upon being disposed at a position to overlap the first fixed position P71. The second position determination part 315 is immovable in the width direction Dw and the axial direction Da with respect to the second support part 8, upon being disposed at a position to overlap the second fixed position P81.

As illustrated in FIG. 6, both ends of the first members 310 of the positioning members 300A disposed at the lower end portions of the first support part 7 and the second support part 8 are fixed to the first lower vertical beam part 73 of the first lower frame body 7*b*. Both ends of the first members 310 of the positioning members 300A disposed at the upper end portions of the first support part 7 and the second support part 8 are fixed to the first upper vertical beam part 71 of the first upper frame body 7*a*. As illustrated in FIG. 11, one end of each first member 310 is detachably fixed to the first upper vertical beam part 71 or the first lower vertical beam part 73 of the second support part 8 using a plurality of bolts and nuts 330. The other end of each first member 310 is detachably fixed to the first upper vertical beam part 71 or the first lower vertical beam part 73 of the first support part 7 using the plurality of bolts and nuts 330.

Figure 12:
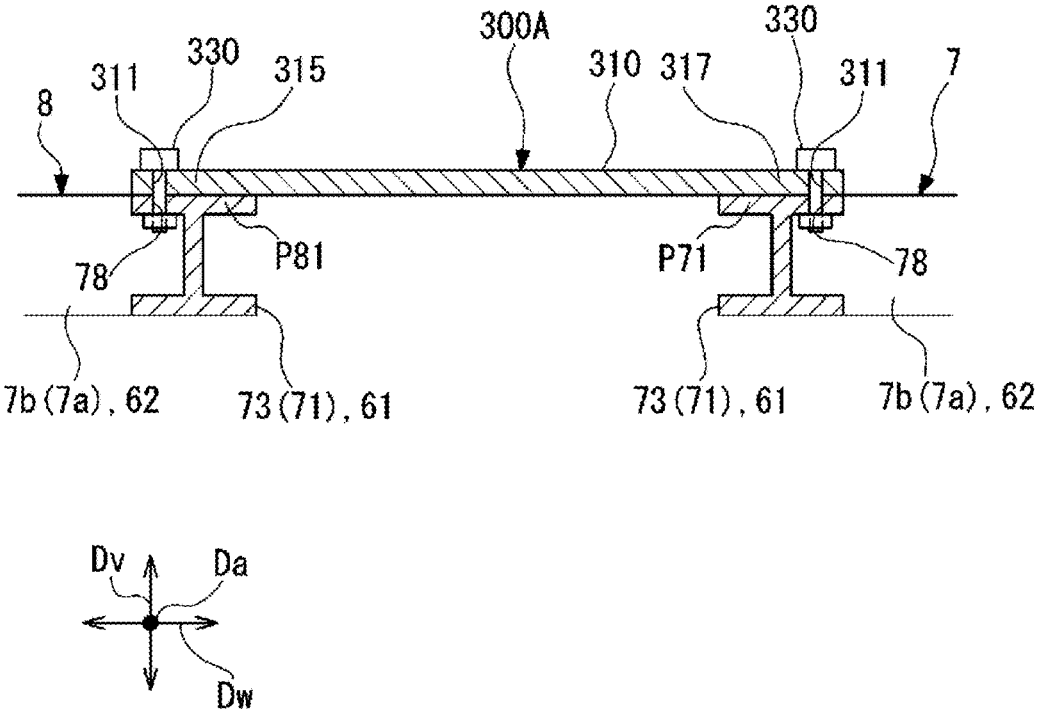
FIG. 12 is a cross-sectional view of the positioning member taken along line XII-XII in FIG. 11 as viewed in the axial direction.

In the process S25, the positioning member 300A is formed adjusted to the temporary installation interval Sd as described above. This is done by placing both ends of each first member 310 of the positioning member 300A assembled in advance, on the first support part 7 and the second support part 8 as illustrated in FIG. 12. In FIG. 12, only the lower flange of the H-shaped steel is illustrated as the first member 310. In the process S25, the procedure performed is the same between cases where the positioning member 300A is disposed at the lower end portion of the first support part 7 and the second support part 8 and where the positioning member 300A is disposed at the upper end portion. Thus, the example of the lower end portion will be described below.

The first member 310 has one end placed on the first lower vertical beam part 73 of the second support part 8, and the other end placed on the first lower vertical beam part 73 of the first support part 7. Thereafter, a through hole through which a bolt can be inserted is formed, by using a tool such as a drill, at a predetermined position in a region where the first member 310 and the first lower vertical beam part 73 of the second support part 8 overlap each other when viewed from the vertical direction Dv. Similarly, a through hole through which a bolt can be inserted is formed at a predetermined position in a region where the first member 310 and the first lower vertical beam part 73 of the first support part 7 overlap each other when viewed from the vertical direction Dv, using a drill or the like. With these configurations, a beam bolt insertion hole 78 is formed through the first lower vertical beam part 73 of the second support part 8 and the first lower vertical beam part 73 of the first support part 7 in the vertical direction Dv, at predetermined positions thereof. In addition, a member bolt insertion hole 311 is formed through each of both end portions of the first member 310 in the vertical direction Dv. The beam bolt insertion hole 78 and the member bolt insertion hole 311 have the same inner diameter. The beam bolt insertion hole 78 and the member bolt insertion hole 311 are formed to have the inner diameters larger than the outer diameter of the bolt shafts of the bolts and nuts 330. In a state where the member bolt insertion hole 311 and the beam bolt insertion hole 78 have positions matched and communicate with each other in the vertical direction Dv, the end portion of the first member 310 and the first lower vertical beam part 73 are fastened to each other using the bolts and nuts 330. Accordingly, the first support part 7 and the second support part 8 are coupled to each other by the positioning member 300A with the temporary installation interval Sd in the width direction Dw.

Figure 13:
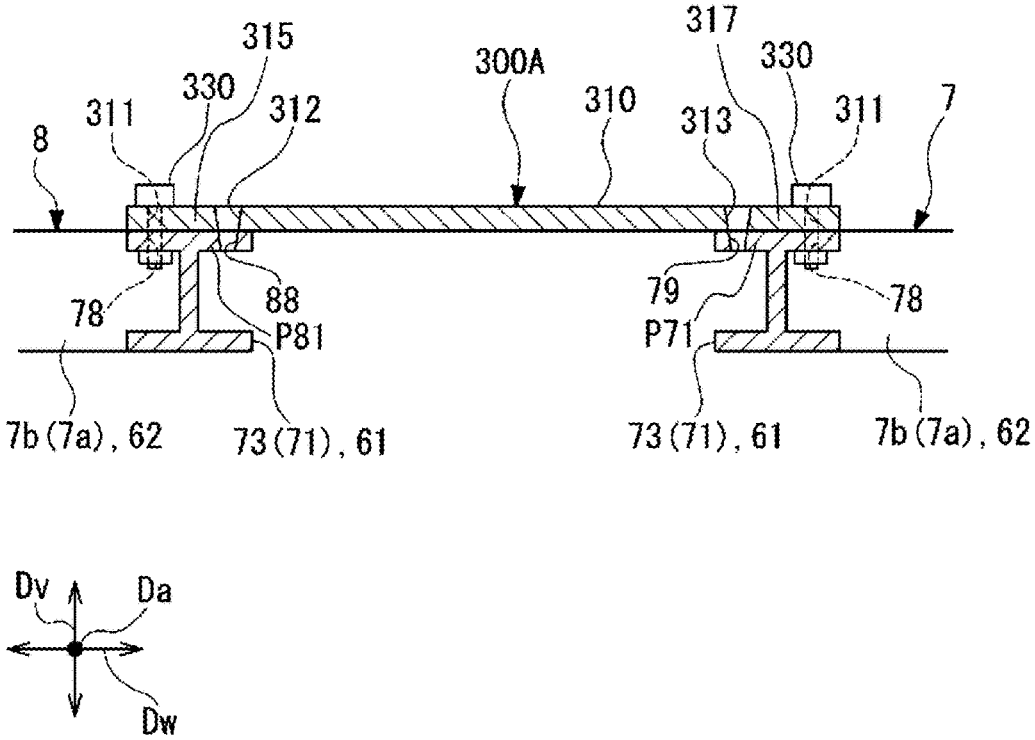
FIG. 13 is a cross-sectional view of the positioning member taken along line XIII-XIII in FIG. 11 as viewed in the axial direction.

Then, as illustrated in FIG. 13, a through hole through which a tapered pin described later can be inserted is formed, by using a tool such as a drill, at a predetermined position in a region where the first member 310 and the first lower vertical beam part 73 of the second support part 8 overlap each other when viewed from the vertical direction Dv. Similarly, a through hole through which a tapered pin can be inserted is formed, using a drill or the like, at a predetermined position in a region where the first member 310 and the first lower vertical beam part 73 of the first support part 7 overlap each other when viewed from the vertical direction Dv. Thus, a second support hole 88 is formed through the first lower vertical beam part 73 of the second support part 8 in the vertical direction Dv, at a predetermined position thereof. Similarly, a first support hole 79 is formed through the first lower vertical beam part 73 of the first support part 7 in the vertical direction Dv, at a predetermined position thereof. In addition, a second insertion hole 312 and a first insertion hole 313 are formed through each of both end portions of the first member 310 in the vertical direction Dv. In a state where the positions of the member bolt insertion hole 311 and the beam bolt insertion hole 78 match, the second insertion hole 312 and the second support hole 88, and the first insertion hole 313 and the first support hole 79 are disposed at matching positions when viewed from the vertical direction Dv. The second insertion hole 312 and the second support hole 88, as well as the first insertion hole 313 and the first support hole 79 are preferably tapered holes having inner diameters gradually decreasing from the upper side to the lower side in the vertical direction Dv. As a result, the two positioning members 300A are formed adjusted to the temporary installation interval Sd in the process S25.

The region of the first support part 7 where the beam bolt insertion hole 78 and the first support hole 79 are formed functions as the first fixed position P71 where the positioning member 300A is held. The region of the second support part 8 where the beam bolt insertion hole 78 and the second support hole 88 are formed functions as the second fixed position P81 where the positioning member 300A is held.

A region of one end of the first member 310 in which the member bolt insertion hole 311 and the second insertion hole 312 are formed functions as the second position determination part 315 immovably fixed to the second support part 8. That is, the second position determination part 315 of the present embodiment is formed at one end of the first member 310. A region of the other end of the first member 310 in which the member bolt insertion hole 311 and the first insertion hole 313 are formed functions as the first position determination part 317 immovably fixed to the first support part 7. That is, the first position determination part 317 of the present embodiment is formed at the other end of the first member 310.

As illustrated in FIG. 7, in the process S26 for recording the dimension, the dimension related to the position of the temporarily assembled compressor module 100 in the vertical direction Dv is recorded on the temporary installation surface 250. Specifically, in the process S26 of the present embodiment, as illustrated in FIG. 10, information on a first interval Sv1 in the vertical direction Dv between the first support part 7 fixed to the temporary installation surface 250 and the temporary installation surface 250 is acquired. More specifically, information on the thickness of the shim 401 in each portion interposed between the first support part 7 and the temporary installation surface 250 is recorded. Furthermore, information on a second interval Sv2 between the second support part 8 fixed on the temporary installation surface 250 and the temporary installation surface 250 in the vertical direction Dv is acquired. More specifically, information on the thickness of the shim 401 in each portion interposed between the second support part 8 and the temporary installation surface 250 is recorded. Furthermore, information on a third interval Sv3 between the third support part 6 fixed on the first support part 7 and the first support part 7 in the vertical direction Dv is acquired. More specifically, information on the thickness of the shim 401 in each portion interposed between the first support part 7 and the third support part 6 is recorded. Furthermore, information on a fourth interval Sv4 between the fourth support part 9 fixed on the second support part 8 and the second support part 8 in the vertical direction Dv is acquired. More specifically, information on the thickness of the shim 401 in each portion interposed between the second support part 8 and the fourth support part 9 is recorded. The process S26 may be performed before the process S25, or may be performed in parallel with the processes S21 to S24.

As illustrated in FIG. 7, in the process S27 for disassembling the compressor module 100, the compressor module 100 temporarily assembled on the temporary installation surface 250 as described above is disassembled. In the process S27, the temporarily assembled compressor module 100 is disassembled into the first unit B, the second unit C, the third unit A, and the fourth unit D. In the process S27, the first unit B, the second unit C, the third unit A, and the fourth unit D are not disassembled any further. The positioning member 300A may be removed from both the first support part Z and the second support part 8, or may remain to be fixed to one of the first support part 7 and the second support part 8 using the bolts and nuts 330.

Thereafter, the first unit B, the second unit C, the third unit A, and the fourth unit D of the compressor module 100 disassembled are transported to the installation location of the compressor module 100.

Process for Installing First Support Part on Installation Surface

Figure 14:
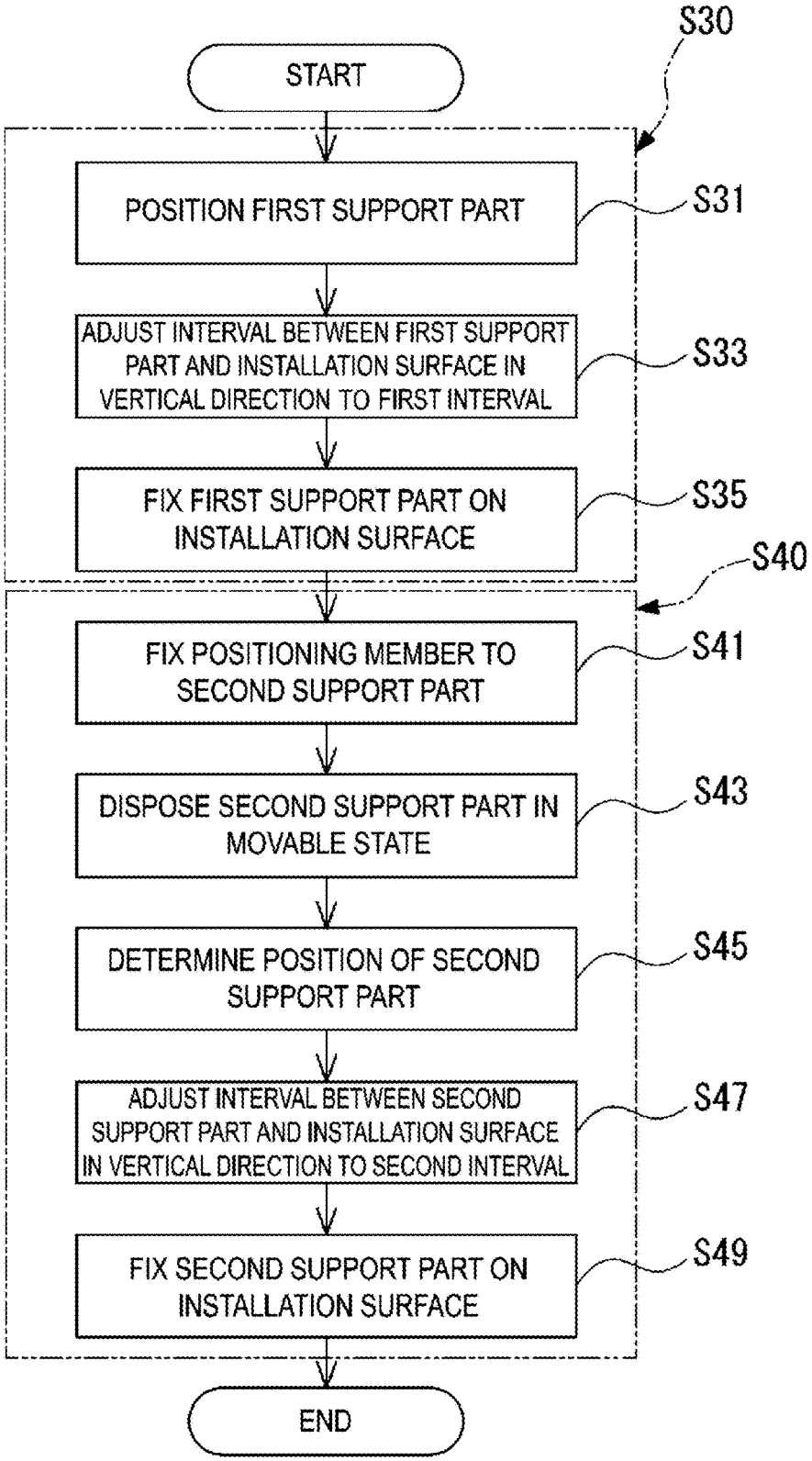
FIG. 14 is a flowchart illustrating a process for installing the first support part on an installation surface and a process for installing the second support part on the installation surface.

As illustrated in FIG. 5, a process S30 for installing the first support part 7 on the installation surface 200 is performed after the positioning member 300A is prepared. The process S30 is performed after the first unit B, the second unit C, the third unit A, and the fourth unit D are transported to the installation location of the compressor module 100. As illustrated in FIG. 14, the process S30 of the present embodiment for installing the first support part 7 on the installation surface 200 includes a process S31 for positioning the first support part 7, a process S33 for adjusting the interval between the first support part 7 and the installation surface 200 in the vertical direction Dv to the first interval Sv1, and a process S35 for fixing the first support part 7 on the installation surface 200.

Figure 15:
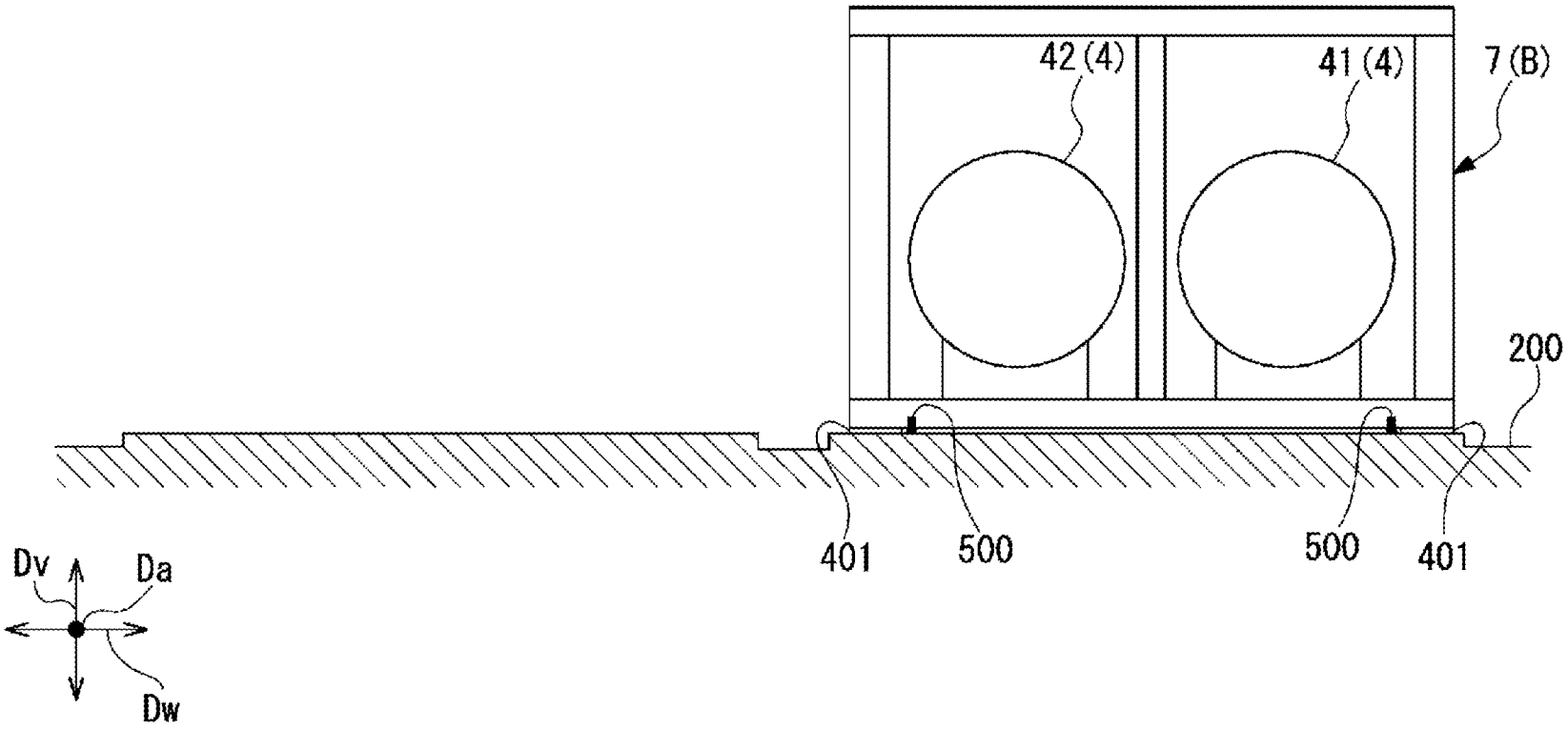
FIG. 15 is a cross-sectional view illustrating a state in which the first support part is fixed on the installation surface.

In the process S31 for positioning the first support part 7, the position of the first support part 7 in the horizontal direction is adjusted, and the first support part 7 is disposed on the installation surface 200. The process S31 is performed before the process S33. As illustrated in FIG. 15, in the process S31 of the present embodiment, the first unit B in an already assembled state is disposed on the installation surface 200. At this time, the first unit B is installed at a predetermined position by positioning the first support part 7 in accordance with a marking line (not illustrated) drawn in advance on the installation surface 200 based on the design dimensions. Accordingly, the first support part 7 is disposed on the installation surface 200 while being adjusted to an appropriate position in the width direction Dw and the axial direction Da.

In the process S33 for adjusting the interval between the first support part 7 and the installation surface 200 in the vertical direction Dv to the first interval Sv1, the position of the first support part 7 with respect to the installation surface 200 in the vertical direction Dv is adjusted. The process S33 is performed before the process S35. In the process S33 of the present embodiment, the position of the first support part 7 in the vertical direction Dv with respect to the installation surface 200 is adjusted to the first interval Sv1 recorded in the process S26 in which the dimension is recorded. At this time, the position of the first support part 7 is adjusted by using the shim 401 which is the same as the shim 401 used in the process S21.

In the process S35 for fixing the first support part 7 on the installation surface 200, the first support part 7 whose position has been adjusted through the process S31 and the process S33 is fixed on the installation surface 200 by using an anchor bolt 500 or the like. As a result, the first unit B is fixed to the installation surface 200 in the same state as the state of being fixed on the temporary installation surface 250. That is, the positional relationship between the temporary installation surface 250 and the first unit B in the width direction Dw, the axial direction Da, and the vertical direction Dv is the same as the positional relationship between the installation surface 200 and the first unit B in the width direction Dw, the axial direction Da, and the vertical direction Dv.

Process for Installing Second Support Part on Installation Surface

As illustrated in FIG. 14, a process S40 for installing the second support part 8 on the installation surface 200 is performed after the process S30 for installing the first support part 7 on the installation surface 200. The process S40 for installing the second support part 8 on the installation surface 200 includes a process S41 for fixing the positioning member 300A to the second support part 8, a process S43 for disposing the second support part 8 while being movable, a process S45 for positioning the second support part 8, a process S47 for adjusting the interval between the second support part 8 and the installation surface 200 in the vertical direction Dv to the second interval Sv2, and a process S49 for fixing the second support part 8 to the installation surface 200.

Figure 16:
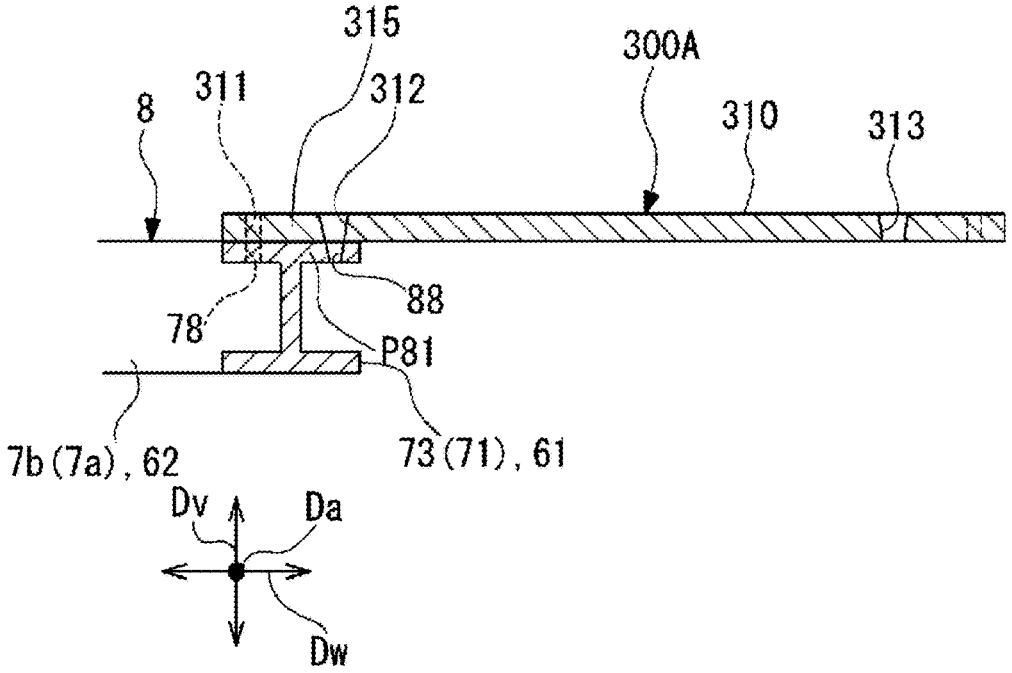
FIG. 16 is a cross-sectional view illustrating a state in which the positioning member is placed on the second support part.
Figure 17:
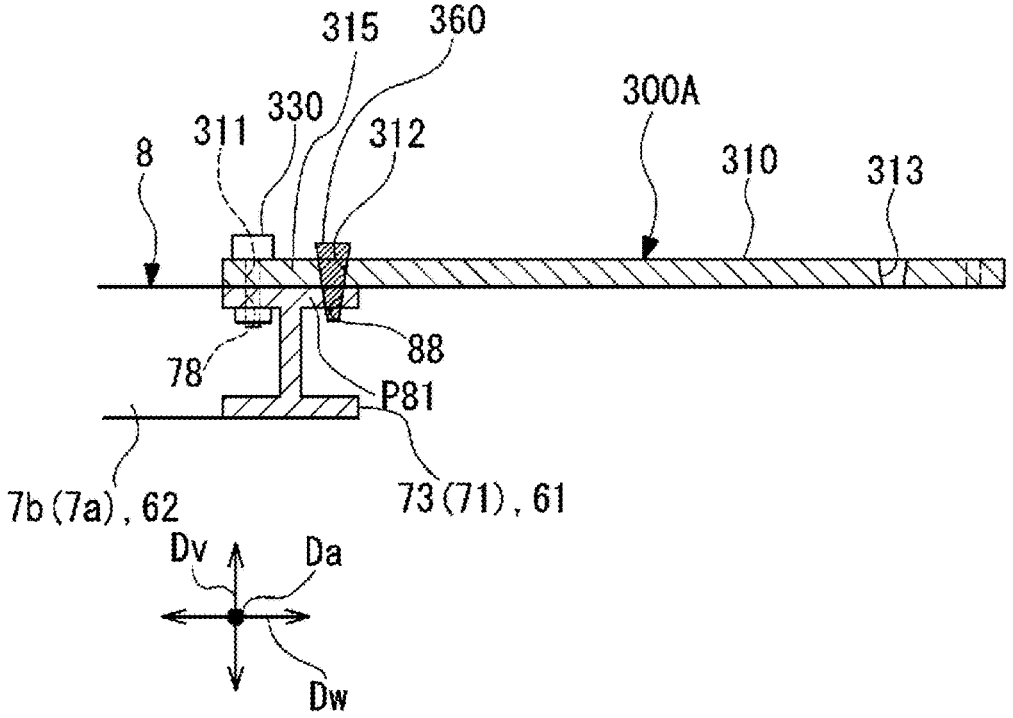
FIG. 17 is a cross-sectional view illustrating a state in which the positioning member is fixed to the second support part.

The process S41 for fixing the positioning member 300A to the second support part 8 is performed before the process S43. In the process S41, the positioning member 300A is attached to the second support part 8 of the second unit C. Specifically, the positioning member 300A is fixed to the second support part 8 with the third cooling unit 43 and the fourth cooling unit 44 fixed. In the present embodiment, the positioning member 300A is disposed at each of the lower end portion and the upper end portion of the second support part 8. Specifically, first, as illustrated in FIG. 16, one end of each of the first members 310 of the positioning member 300A is placed on the first lower vertical beam part 73 (first upper vertical beam part 71) of the second support part 8 so as to overlap the region where the second support hole 88 is formed. That is, the region of the first member 310 where the second insertion hole 312 is formed overlaps the region of the second support part 8 that functions as the second fixed position P81. In a state where the first member 310 overlaps the second support part 8, the position of the positioning member 300A in the width direction Dw and the axial direction Da is adjusted such that the second insertion hole 312 formed at one end of the first member 310 overlaps the second support hole 88. In a state where the second insertion hole 312 overlaps the second support hole 88 and communicates with the second support hole 88 in the vertical direction Dv, a second pin 360 is inserted into the second insertion hole 312 and the second support hole 88 as illustrated in FIG. 17. Here, the second pin 360 is a tapered pin having an outer diameter gradually decreasing from the upper side toward the lower side in the vertical direction Dv.

Thus, in a state where the second position determination part 315 is disposed at a position overlapping the second fixed position P81, the one end of the first member 310 is immovable with respect to the first lower vertical beam part 73 (first upper vertical beam part 71) of the second support part 8. In this manner, in a state where the first member 310 is immovable in the width direction Dw and the axial direction Da with respect to the second support part 8, the bolts and nuts 330 are fastened to the member bolt insertion hole 311 and the beam bolt insertion hole 78 formed through in the vertical direction Dv. Accordingly, in the process S41, the positioning member 300A is fixed to the second support part 8 again in the same state as the state of being fixed to the second support part 8 on the temporary installation surface 250. That is, the positional relationship between the positioning member 300A and the second support part 8 in the width direction Dw, the axial direction Da, and the vertical direction Dv at the time of temporary assembly is the same as the positional relationship between the positioning member 300A and the second support part 8 in the width direction Dw, the axial direction Da, and the vertical direction Dv after the process S41.

Figure 18:
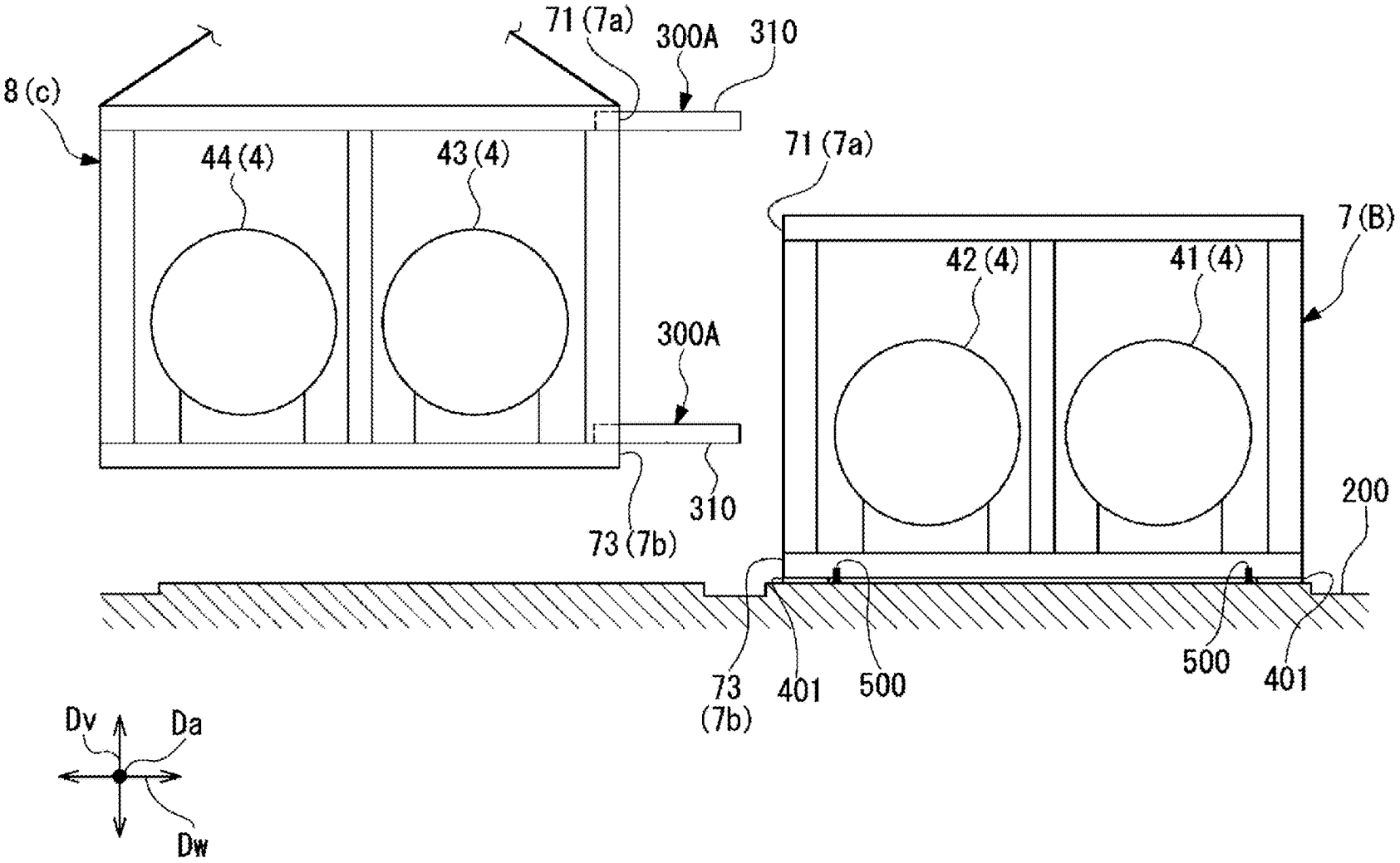
FIG. 18 is a diagram illustrating a state in which the second support part is disposed while being movable.

As illustrated in FIG. 14, the process S43 for disposing the second support part 8 while being movable is performed after the process S41. In the process S43, as illustrated in FIG. 18, suspending the second support part 8 with a crane or the like disposes the second support part 8 in a movable state spaced in the width direction Dw from the first support part 7. The positioning member 300A is suspended from the second support part 8 in a fixed state. The second support part 8 is moved to a position close to the first support part 7 without being lowered onto the installation surface 200.

Figure 19:
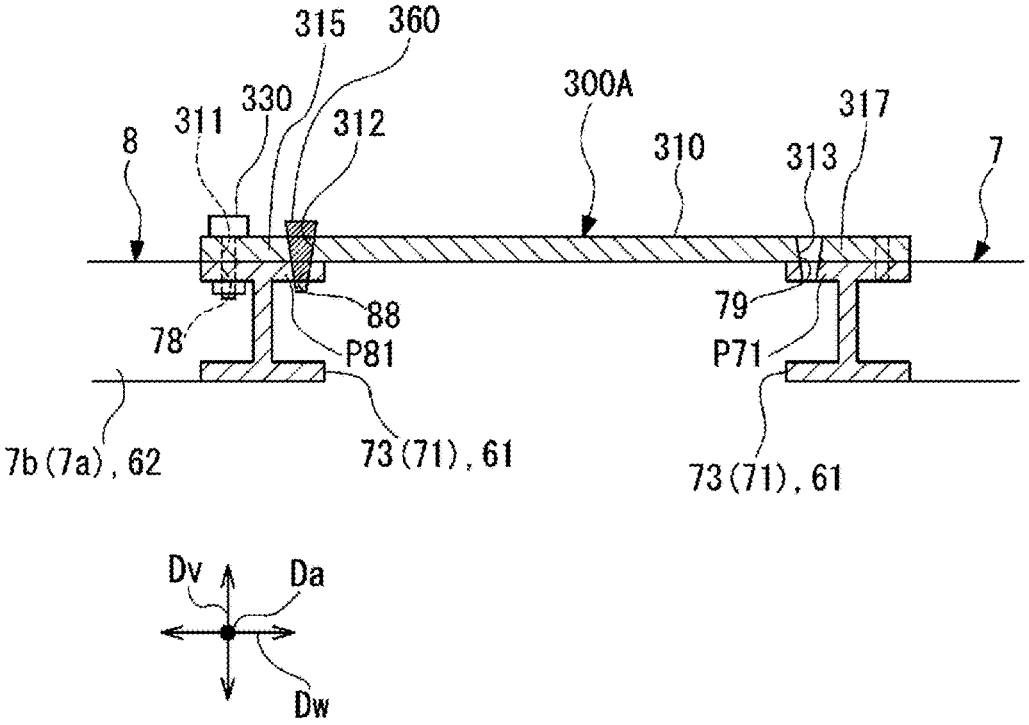
FIG. 19 is a cross-sectional view illustrating a state in which the positioning member is placed on the first support part.
Figure 20:
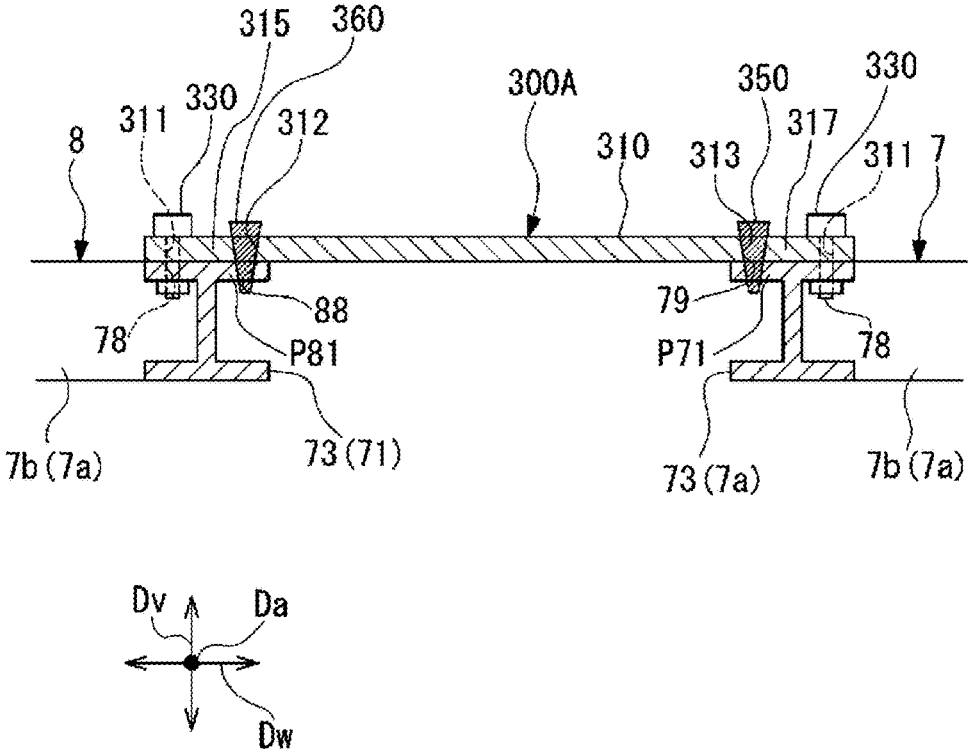
FIG. 20 is a cross-sectional view illustrating a state in which the first support part and the second support part are adjusted to an installation interval by using the positioning member.

As illustrated in FIG. 14, the process S45 for positioning the second support part 8 is performed after the process S43. In the process S45, the interval between the first support part 7 and the second support part 8 in the width direction Dw is adjusted to the temporary installation interval Sd set to be the installation interval Ld by the positioning member 300A. This causes the second support part 8 with respect to the first support part 7 on the installation surface 200 in the width direction Dw and the axial direction Da to be positioned. Specifically, the second support part 8 suspended by a crane or the like as illustrated in FIG. 18 and movable with respect to the first support part 7 is moved. As a result, as illustrated in FIG. 19, the other end of the first member 310 of the positioning member 300A is placed on the first lower vertical beam part 73 (first upper vertical beam part 71) of the first support part 7 so as to overlap the region where the first support hole 79 is formed. That is, the region of the first member 310 where the first insertion hole 313 is formed overlaps the region of the first support part 7 that functions as the first fixed position P71. In a state where the first member 310 overlaps the first support part 7, the position of the positioning member 300A in the width direction Dw and the axial direction Da is adjusted by moving the second support part 8 such that the first insertion hole 313 formed at the other end of the first member 310 overlaps the first support hole 79. In a state where the first insertion hole 313 overlaps the first support hole 79 and communicates with the first support hole 79 in the vertical direction Dv, a first pin 350 is inserted into the first insertion hole 313 and the first support hole 79 as illustrated in FIG. 20. Here, the first pin 350 is a tapered pin having an outer diameter gradually decreasing from the upper side toward the lower side in the vertical direction Dv. The first pin 350 is a member having the same shape as the second pin 360.

Thus, in a state where the first position determination part 317 is disposed at a position overlapping the first fixed position P71, the other end of the first member 310 is immovable with respect to the first lower vertical beam part 73 (first upper vertical beam part 71) of the first support part 7. Accordingly, in the process S45, the positioning member 300A is fixed to the first support part 7 again in the same state as the state of being fixed to the first support part 7 on the temporary installation surface 250. That is, the positional relationship between the positioning member 300A and the first support part 7 in the width direction Dw, the axial direction Da, and the vertical direction Dv at the time of temporary assembly is the same as the positional relationship between the positioning member 300A and the first support part 7 in the width direction Dw, the axial direction Da, and the vertical direction Dv after the process S45. The positioning member 300A is fixed to the second support part 8 in the same positional relationship as that at the time of temporary assembly. As a result, the positional relationship between the first support part 7 and the second support part 8 in the width direction Dw, the axial direction Da, and the vertical direction Dv after the process S45 is the same as the positional relationship between the first support part 7 and the second support part 8 in the width direction Dw, the axial direction Da, and the vertical direction Dv at the time of temporary assembly. Accordingly, positioning the second support part 8 with respect to the first support part 7 on the installation surface 200 in the width direction Dw and the axial direction Da is completed.

In the process S45, in a state where the first member 310 is immovable in the width direction Dw and the axial direction Da with respect to the first support part 7, the bolts and nuts 330 may be fastened to the member bolt insertion hole 311 and the beam bolt insertion hole 78 formed through in the vertical direction Dv.

Figure 21:
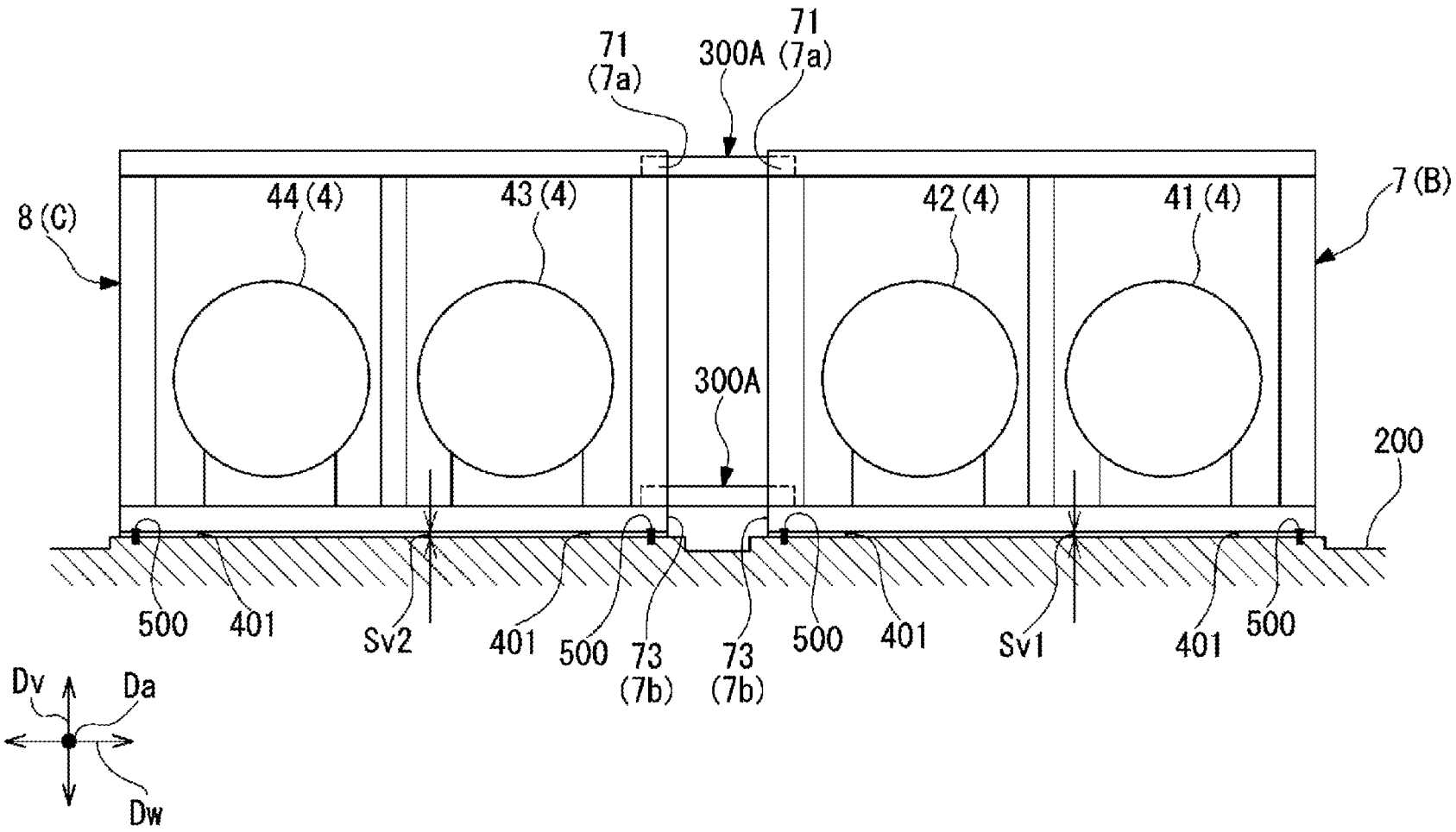
FIG. 21 is a diagram illustrating the first support part and the second support part disposed on the installation surface while being adjusted to the installation interval by using the positioning member.

In the process S47 for adjusting the interval between the second support part 8 and the installation surface 200 in the vertical direction Dv to the second interval Sv2, the position of the second support part 8 with respect to the installation surface 200 in the vertical direction Dv is adjusted as illustrated in FIG. 21. The process S47 is performed before the process S49. In the process S47 of the present embodiment, the position of the second support part 8 in the vertical direction Dv with respect to the installation surface 200 is adjusted to the second interval Sv2 recorded in the process S26 in which the dimension is recorded. At this time, the position of the second support part 8 is adjusted by using the shim 401 which is the same as the shim 401 used in the process S22.

In the process S49 for fixing the second support part 8 on the installation surface 200, the second support part 8 whose position has been adjusted through the process S45 and the process S47 is fixed on the installation surface 200 by using the anchor bolt 500 or the like. As a result, the second unit C is fixed on the installation surface 200 in the same state as the state of being fixed on the temporary installation surface 250. That is, the positional relationship between the temporary installation surface 250 and the second unit C in the width direction Dw, the axial direction Da, and the vertical direction Dv is the same as the positional relationship between the installation surface 200 and the second unit C in the width direction Dw, the axial direction Da, and the vertical direction Dv.

Process for Fixing Third Support Part on First Support Part

Figure 22:
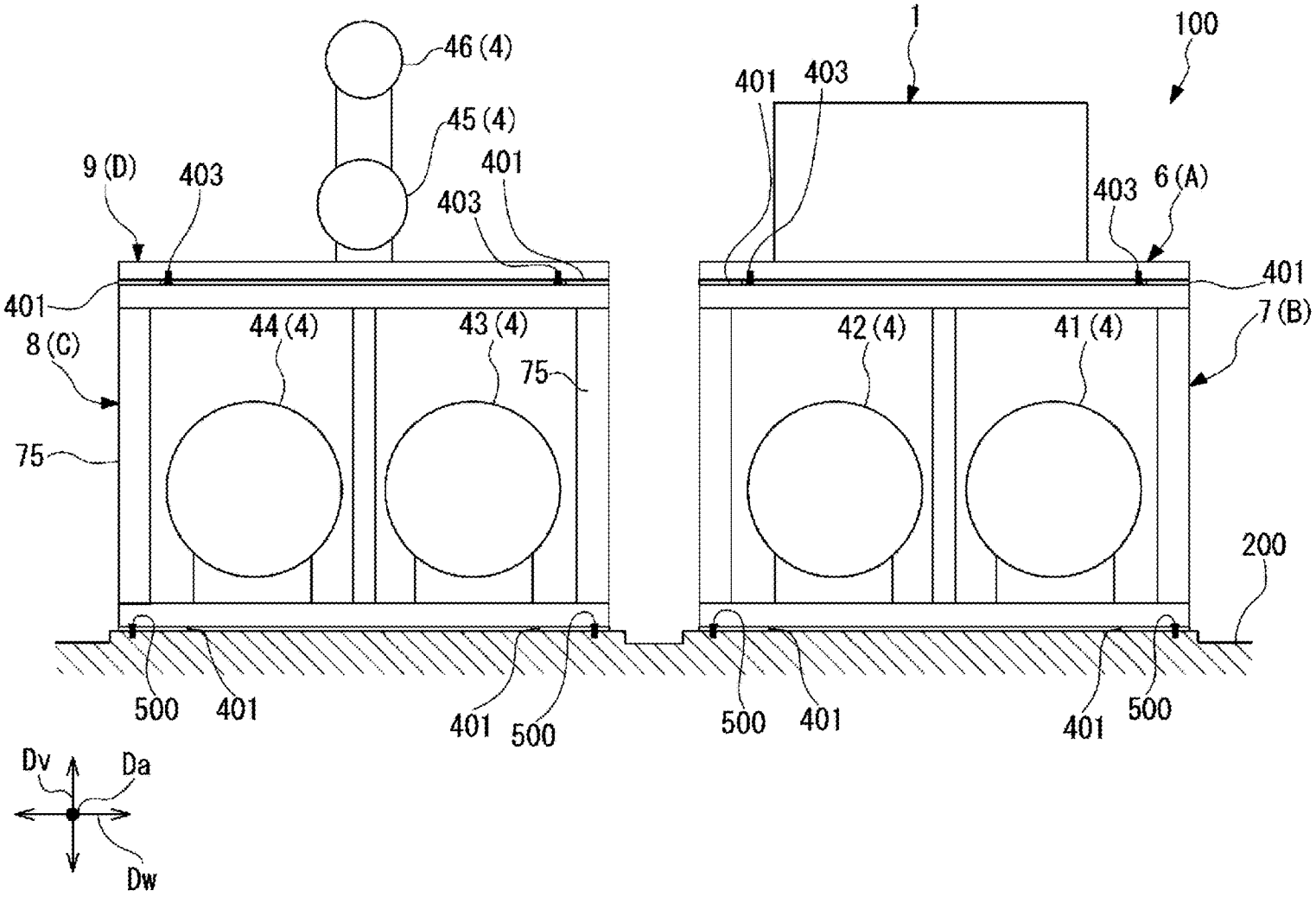
FIG. 22 is a diagram illustrating a state in which on the installation surface, the third support part is disposed on the first support part and the fourth support part is disposed on the second support part.

In a process S50 for fixing the third support part 6 on the first support part 7, as illustrated in FIG. 22, the third support part 6 is disposed directly above the first support part 7. Specifically, suspending the third support part 6 with a crane or the like disposes the third support part 6 in a movable state spaced in the vertical direction Dv from the first support part 7. Then, the position of the third support part 6 is determined with respect to the first support part 7 based on a marking line drawn on the first support part 7. Regarding the third support part 6, the position of the third support part 6 in the vertical direction Dv with respect to the first support part 7 is adjusted to the third interval Sv3 recorded in the process S26 for recording the dimension. At this time, the height adjustment bolt 403 is set to the same height as the process S23. The position of the third support part 6 is adjusted by using the shim 401 which is the same as the shim 401 used in the process S23. The third support part 6 whose position has been thus adjusted is fixed to the first support part 7 by using a bolt or the like. As a result, the third unit A is fixed to the first support part 7 on the installation surface 200 in the same state as the state of being fixed to the first support part 7 on the temporary installation surface 250. Thus, the positional relationship between the first unit B and the third unit A in the width direction Dw, the axial direction Da, and the vertical direction Dv is the same as the positional relationship at the time of temporary assembly.

Process for Fixing Fourth Support Part on Second Support Part

In the process S60 for fixing the fourth support part 9 on the second support part 8, the fourth support part 9 is disposed directly above the second support part 8. Specifically, suspending the fourth support part 9 with a crane or the like disposes the fourth support part 9 in a movable state spaced in the vertical direction Dv from the second support part 8. Thereafter, the position of the fourth support part 9 is determined with respect to the second support part 8 based on a marking line drawn on the second support part 8. Regarding the fourth support part 9, the position of the fourth support part 9 in the vertical direction Dv with respect to the second support part 8 is adjusted to the fourth interval Sv4 recorded in the process S26 for recording the dimension. At this time, the height adjustment bolt 403 is set to the same height as the process S24. The position of the fourth support part 9 is adjusted by using the shim 401 which is the same as the shim 401 used in the process S24. The fourth support part 9 whose position has been thus adjusted is fixed to the second support part 8 by using a bolt or the like. As a result, the fourth unit D is fixed to the second support part 8 on the installation surface 200 in the same state as the state of being fixed to the second support part 8 on the temporary installation surface 250. Thus, the positional relationship between the second unit C and the fourth unit D in the width direction Dw, the axial direction Da, and the vertical direction Dv is the same as the positional relationship at the time of temporary assembly.

Thereafter, the positioning member 300A between the first support part 7 and the second support part 8 is removed. The positioning member 300A may not be removed and may remain fixed to the compressor module 100 during operation. Thus, the compressor module 100 is installed on the installation surface 200.

Actions and Effects

According to the method S10 for assembling the compressor module 100 and the compressor module 100 with the above-described configuration, the positioning member 300A formed adjusted to the temporary installation interval Sd which can be regarded as the installation interval Ld between the first support part 7 and the second support part 8 in the width direction Dw is prepared in advance. Then, after the first unit B is fixed on the installation surface 200, the second unit C id disposed while having the second support part 8 disposed in a movable state spaced in the width direction Dw from the first support part 7. Thereafter, the second unit C is positioned with the interval of the second support part 8 in the width direction Dw with respect to the first support part 7 adjusted to the temporary installation interval Sd by the positioning member 300A and is fixed on the installation surface 200. Accordingly, the interval between the first support part 7 and the second support part 8 in the width direction Dw can be fixed on the installation surface 200 in accordance with the temporary installation interval Sd with high accuracy. Therefore, the first support part 7 and the second support part 8 can be easily installed with high accuracy by the positioning member 300A without performing fine position adjustment on the installation surface 200. As a result, the compressor module 100 can be efficiently assembled with high accuracy.

Before the second support part 8 is disposed while being movable with respect to the first support part 7, the positioning member 300A is fixed to the second support part 8. That is, before the second unit C is moved, the positioning member 300A is fixed to the second support part 8, and the second support part 8 and the positioning member 300A are being integrally movable. Accordingly, the interval between the first support part 7 and the second support part 8 in the width direction Dw can be adjusted to the temporary installation interval Sd by the positioning member 300A only by moving the second unit C. Therefore, when the interval between the first support part 7 and the second support part 8 in the width direction Dw is adjusted to the temporary installation interval Sd, it is possible to omit the labor of fixing the positioning member 300A to both the first support part 7 and the second support part 8 on the installation surface 200. This reduces the work on the installation surface 200, and the work for determining the positions of the first support part 7 and the second support part 8 can be efficiently performed.

In preparing the positioning member 300A, the first unit B, the second unit C, the third unit A, and the fourth unit D are assembled on the temporary installation surface 250 set at another location different from the installation surface 200. At this time, the positioning member 300A is formed with the interval in the width direction Dw between the first support part 7 and the second support part 8 fixed on the temporary installation surface 250 being the temporary installation interval Sd that can be regarded as the installation interval Ld. That is, the positioning member 300A can be formed based on the temporary installation interval Sd which is the interval in the width direction Dw between the first support part 7 and the second support part 8 whose relative positions are determined on the temporary installation surface 250. By fixing the first support part 7 and the second support part 8 on the installation surface 200 by using such a positioning member 300A, the interval in the width direction Dw between the first support part 7 and the second support part 8 on the installation surface 200 can be easily adjusted to the temporary installation interval Sd. That is, the relative positions of the first support part 7 and the second support part 8 determined on the temporary installation surface 250 can be reproduced on the installation surface 200 with high accuracy and efficiency. Accordingly, the first support part 7 and the second support part 8 can be easily installed on the installation surface 200 with high accuracy.

In positioning the positioning member 300A with respect to the first support part 7, the first position determination part 317 of the positioning member 300A is disposed overlapping the first fixed position P71 set in the first upper vertical beam part 71 and the first lower vertical beam part 73 of the first support part 7. In this way, the positioning member 300A can be easily positioned with respect to the first support part 7 via the positioning member 300A by simply moving the first fixed position P71 and the first position determination part 317 to overlap each other.

In addition, in a state where the first insertion hole 313 of the positioning member 300A is disposed at a position overlapping the first support hole 79 of the first support part 7, the first pin 350 is inserted into the first insertion hole 313 and the first support hole 79 communicating with each other in the vertical direction Dv. This allows the first pin 350 to simultaneously position the positioning member 300A with respect to the first support part 7 in the width direction Dw and the axial direction Da. That is, the positioning of the second support part 8 to which the positioning member 300A is fixed with respect to the first support part 7 in the width direction Dw and the axial direction Da can be performed at once using the first pin 350. In this way, the positioning member 300A and the second support part 8 to which the positioning member 300A is fixed can be easily disposed at accurate positions with respect to the first support part 7 by a simple operation of only inserting the first pin 350 into the first insertion hole 313 and the first support hole 79.

When the positioning member 300A is fixed to the second support part 8, the second position determination part 315 of the positioning member 300A is disposed to overlap the second fixed position P81 set in the first upper vertical beam part 71 and the first lower vertical beam part 73 of the second support part 8. In this way, the positioning member 300A can be easily positioned with respect to the second support part 8 by simply moving the second fixed position P81 and the second position determination part 315 to overlap each other.

In addition, in a state where the second insertion hole 312 of the positioning member 300A is disposed at a position overlapping the second support hole 88 of the second support part 8, the second pin 360 is inserted into the second insertion hole 312 and the second support hole 88 communicating with each other in the vertical direction Dv. This can simultaneously position the positioning member 300A with respect to the second support part 8 in the width direction Dw and the axial direction Da. In this way, the positioning member 300A can be easily disposed at accurate positions with respect to the second support part 8 by a simple operation of only inserting the second pin 360 into the second insertion hole 312 and the second support hole 88.

The first pin 350 and the second pin 360 are tapered pins. Therefore, even if the positions of the first insertion hole 313 and the first support hole 79 are slightly deviated from each other, the insertability of the first pin 350 can be guaranteed. Similarly, even if the positions of the second insertion hole 312 and the second support hole 88 are slightly deviated, the insertability of the second pin 360 can be guaranteed. Therefore, the first pin 350 and the second pin 360 can be stably inserted into the first insertion hole 313 and the first support hole 79, and the second insertion hole 312 and the second support hole 88. Accordingly, the positioning member 300A can be stably disposed at an accurate position with respect to the first support part 7 and the second support part 8.

In addition, in the positioning member 300A, the plurality of first members 310 disposed spaced in the axial direction Da are coupled to each other by the coupling member 320. Accordingly, the rigidity of the positioning member 300A can be improved. Therefore, even if the positioning member 300A comes into contact with the first support part 7 or the second support part 8, it is possible to suppress the deformation leading to degradation of the function for determining the relative positions. As a result, the second support part 8 can be stably positioned with respect to the first support part 7 with high accuracy.

In addition, the first interval Sv1 in the vertical direction Dv between the first support part 7 fixed to the temporary installation surface 250 and the temporary installation surface 250 and the second interval Sv2 in the vertical direction Dv between the second support part 8 fixed to the temporary installation surface 250 and the temporary installation surface 250 are recorded. Then, the recorded first interval Sv1 is used to adjust the interval between the first support part 7 and the installation surface 200 in the vertical direction Dv before the process S35 for fixing the first support part 7 on the installation surface 200. Furthermore, the recorded second interval Sv2 is used to adjust the interval between the second support part 8 and the installation surface 200 in the vertical direction Dv before the process S49 for fixing the second support part 8 on the installation surface 200. Accordingly, the first support part 7 and the second support part 8 installed on the installation surface 200 can be adjusted to the height of the first support part 7 and the second support part 8 in the vertical direction Dv in a state of being fixed on the temporary installation surface 250. That is, the positions of the first support part 7 and the second support part 8 in the vertical direction Dv determined on the temporary installation surface 250 can be reproduced on the installation surface 200 with high accuracy and efficiency. Accordingly, it is possible to omit work of finely adjusting the positions of the first support part 7 and the second support part 8 in the vertical direction Dv on the installation surface 200, and to easily install the first support part 7 and the second support part 8 with high accuracy.

Similarly, the third interval Sv3 in the vertical direction Dv between the first support part 7 and the third support part 6 fixed to the temporary installation surface 250 and the fourth interval Sv4 in the vertical direction Dv between the second support part 8 and the fourth support part 9 fixed to the temporary installation surface 250 are recorded. Then, the recorded third interval Sv3 is used to adjust the interval in the vertical direction Dv between the first support part 7 and the third support part 6 on the installation surface 200. Further, the recorded fourth interval Sv4 is used to adjust the interval in the vertical direction Dv between the second support part 8 and the fourth support part 9 on the installation surface 200. Accordingly, the third support part 6 and the fourth support part 9 on the installation surface 200 can be adjusted to the heights of the third support part 6 and the fourth support part 9 on the temporary installation surface 250 in the vertical direction Dv. That is, the positions of the third support part 6 and the fourth support part 9 in the vertical direction Dv determined on the temporary installation surface 250 can be reproduced on the installation surface 200 with high accuracy and efficiency. Accordingly, it is possible to omit work of finely adjusting the positions of the third support part 6 and the fourth support part 9 in the vertical direction Dv on the installation surface 200, and to easily install the first support part 7 and the second support part 8 with high accuracy.

Other Embodiments

Although the embodiments of the present disclosure have been described in detail above with reference to the accompanying drawings, specific configurations are not limited to these embodiments, and design changes and the like without departing from the gist of the present disclosure are also included.

The compressor 1 is not limited to a geared compressor and may be another type of the compressor 1 such as a multistage centrifugal compressor.

The rotary drive machine 2 is not limited to an electric motor, and it may be one that can drive the compressor 1. Therefore, the rotary drive machine 2 may be a steam turbine or a gas turbine.

The configuration of the compressor module 100 of the present embodiment is not limited to the configuration of the above embodiment. For example, the compressor module 100 may have a structure not including the fourth unit D and but including only the first unit B, the second unit C, and the third unit A.

The configuration is not limited to a configuration in which only the compressor 1 and the gas supply device 3 are fixed on the third support part 6. For example, another cooling unit 4 may be fixed on the third support part 6. The configuration is not limited to a configuration in which only the first cooling unit 41 and the second cooling unit 42 are fixed to the first support part 7. Three or more cooling units 4 including other cooling units 4 may be fixed to the first support part 7. Similarly, the configuration is not limited to a configuration in which only the third cooling unit 43 and the fourth cooling unit 44 are fixed to the second support part 8. Three or more cooling units 4 including other cooling units 4 may be fixed to the second support part 8.

The structures of the first support part 7, the second support part 8, the third support part 6, and the fourth support part 9 are not limited to the above-described structures. Furthermore, the first support part 7, the second support part 8, the third support part 6, and the fourth support part 9 may have different structures from one another.

The first support part 7 and the second support part 8 are not limited to the structure in which they are disposed apart from each other. For example, the first support part 7 and the second support part 8 may be fixed to each other by a connection member such as a joint.

The positioning member 300A is not limited to the structure of the above embodiment. Various structures as in the following modified examples are applied to the positioning member 300A.

First Modified Example

For example, according to the positioning member 300A of the above embodiment, the positioning of the second support part 8 with respect to the first support part 7 in the width direction Dw and the axial direction Da is performed at the same position with the first pin 350 which is a tapered pin inserted into the first insertion hole 313 and the first support hole 79. However, the structure of the positioning member 300A is not limited to the structure in which the positioning in the width direction Dw and the axial direction Da is performed at the same position as in such a case of a single pin.

Figure 23:
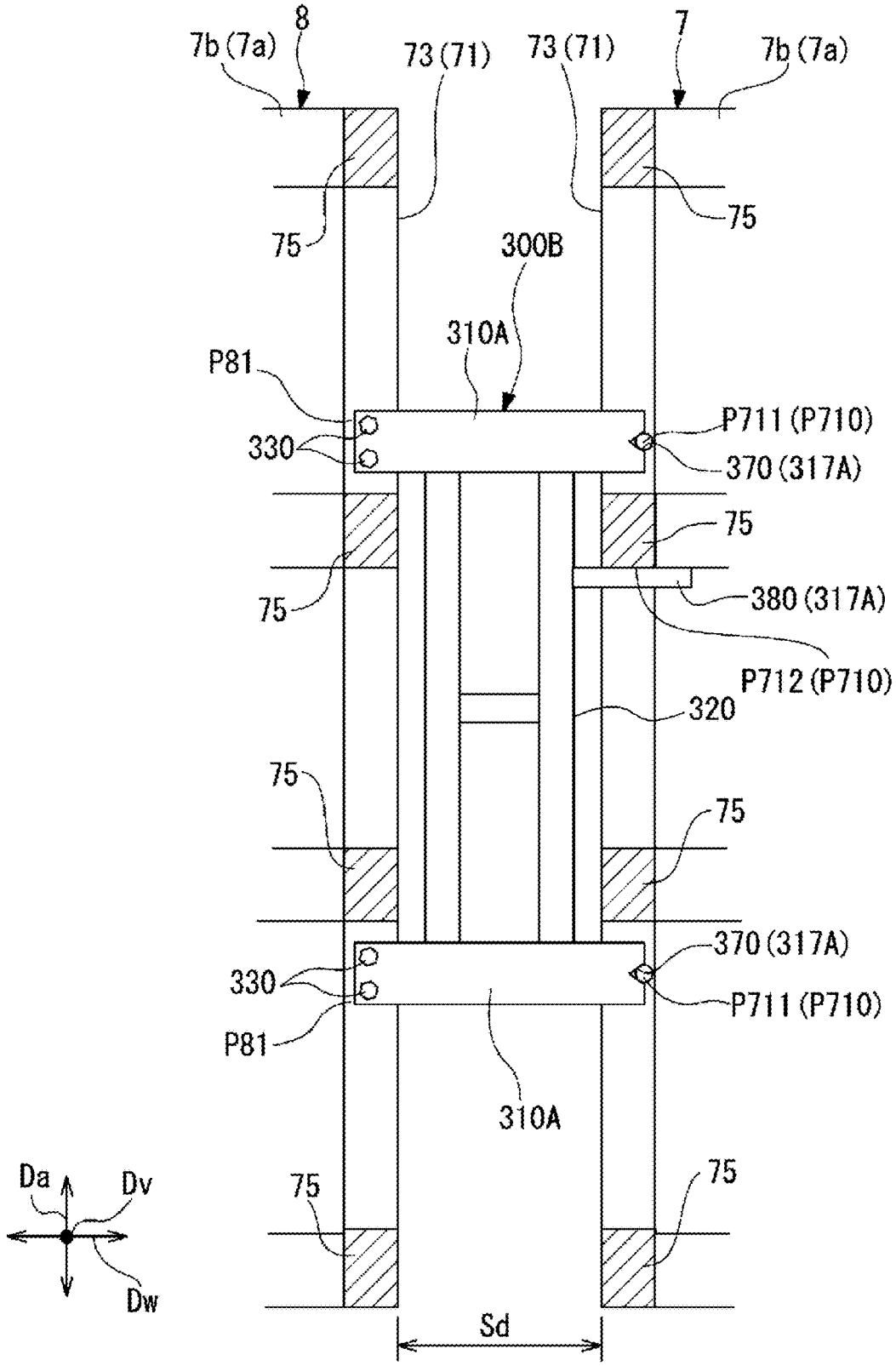
FIG. 23 is a plan view illustrating a positioning member according to a first modified example of the present embodiment.

For example, as illustrated in FIG. 23, according to a positioning member 300B according to the first modified example of the present disclosure, the positioning in the width direction Dw and the positioning in the axial direction Da are performed at different positions. Specifically, in the positioning member 300B, the first position determination part 317A includes a first horizontal contact part 370 and a first vertical contact part 380.

The first horizontal contact part 370 can contact the first support part 7 from the width direction Dw. The first horizontal contact part 370 of the first modified example is a groove formed at the other end of a first member 310A. The first horizontal contact part 370 of the first modified example is recessed in the width direction Dw in a V-shape from an end surface of the first member 310A when viewed from the vertical direction Dv.

The first vertical contact part 380 can contact the first support part 7 from the axial direction Da. The first vertical contact part 380 of the present embodiment is disposed between the pair of first members 310A in the axial direction Da. The first vertical contact part 380 is a plate-shaped member connected to the coupling member 320. The first vertical contact part 380 extends to protrude from the coupling member 320 in the width direction Dw.

Further, in the first support part 7, a first fixed position P710 includes a first horizontal fixed position P711 and a first vertical fixed position P712. The first horizontal fixed position P711 makes the positioning member 300B immovable in the width direction Dw with respect to the first support part 7, upon coming into contact with the first horizontal contact part 370 from the width direction Dw. The first horizontal fixed position P711 of the first modified example is a pin-shaped member fixed to the first lower vertical beam part 73 (the first upper vertical beam part 71). The first horizontal fixed position P711 extends straight upward in the vertical direction Dv from the upper surface of the first lower vertical beam part 73 (first upper vertical beam part 71).

The first vertical fixed position P712 makes the positioning member 300B immovable in the axial direction Da with respect to the first support part 7, upon coming into contact with the first vertical contact part 380 from the axial direction Da. The first vertical fixed position P712 of the first modified example is the column part 75.

According to such a positioning member 300B, the first horizontal contact part 370, which is a groove, is pressed against the first horizontal fixed position P711, which is a pin-shaped member, from the width direction Dw. As a result, the positioning member 300B cannot move close to the first support part 7 in the width direction Dw with respect to the first support part 7. The plate-shaped first vertical contact part 380 is pressed against the column part 75 from the axial direction Da. As a result, the positioning member 300B cannot move close to the column part 75 in the axial direction Da with respect to the first support part 7. In this manner, also in the first modified example, the second support part 8 can be easily and reliably positioned with respect to the first support part 7 in the process S45 for positioning the second support part 8 with respect to the first support part 7.

Second Modified Example

Figure 24:
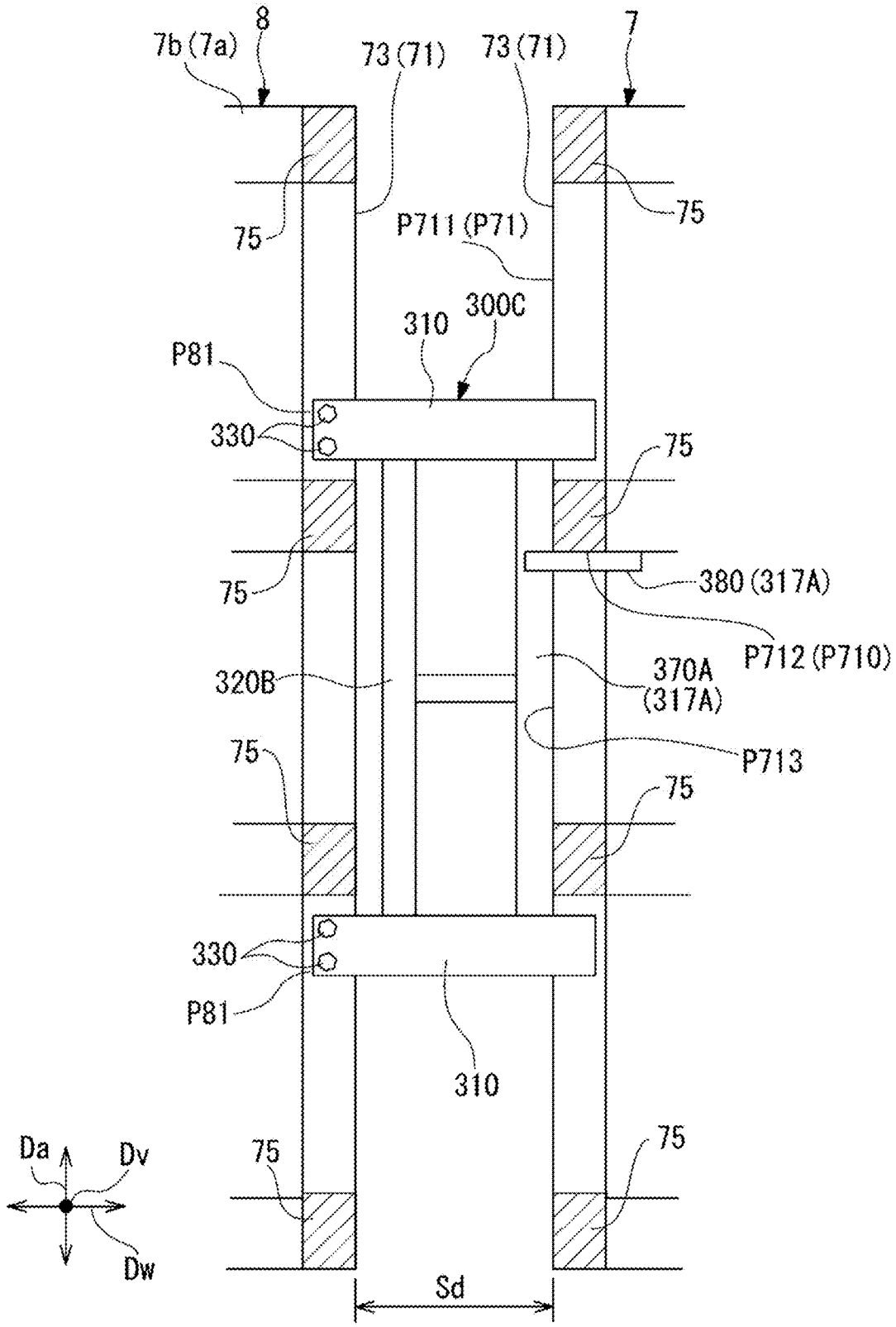
FIG. 24 is a plan view illustrating a positioning member according to a second modified example of the present embodiment.

The first horizontal contact part 370 and the first vertical contact part 380 are not limited to the structure of the first modified example described above. For example, as illustrated in FIG. 24, according to a positioning member 300C of a second modified example, a coupling member 320B serves as a first horizontal contact part 370A. Specifically, in the width direction Dw, the end surface of the coupling member 320B facing the first support part 7 serves as the first horizontal contact part 370A. In this case, a first horizontal fixed position P713 serves as the first lower vertical beam part 73 (the first upper vertical beam part 71).

According to such a positioning member 300C, the end surface of the coupling member 320B is pressed against the first lower vertical beam part 73 (the first upper vertical beam part 71) from the width direction Dw. As a result, the positioning member 300C cannot move close to the first support part 7 in the width direction Dw with respect to the first support part 7. In this manner, also in the second modified example, the second support part 8 can be easily and reliably positioned with respect to the first support part 7 in the process S45 for positioning the second support part 8 with respect to the first support part 7.

Third Modified Example

Figure 25:
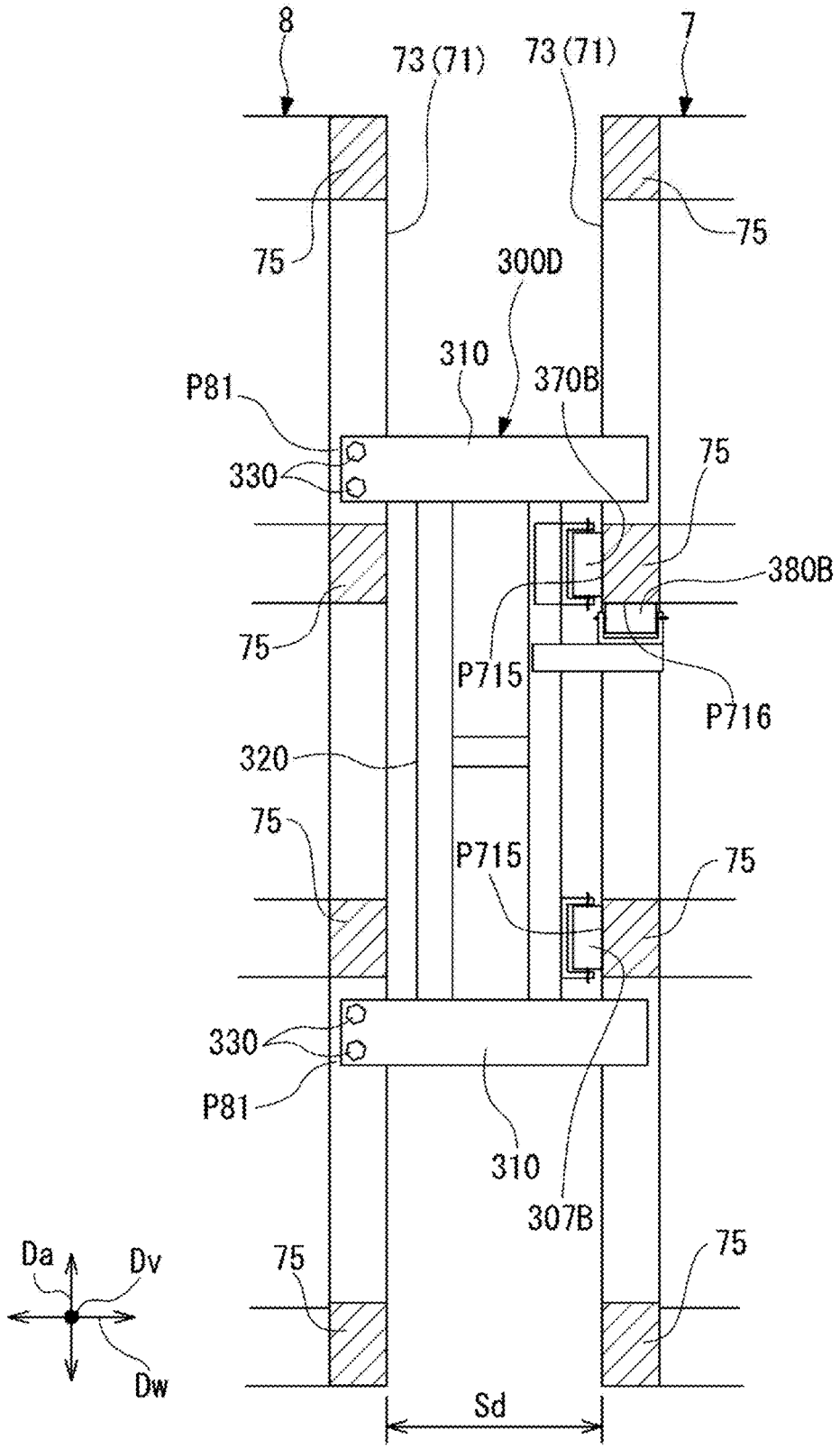
FIG. 25 is a plan view illustrating a positioning member according to a third modified example of the present embodiment.

As illustrated in FIG. 25, according to a positioning member 300D according to a third modified example, a first horizontal contact part 370B and a first vertical contact part 380B have rollers in regions that come into contact with the first support part 7. The first horizontal contact part 370B of the third modified example includes a roller that is rotatable about a shaft extending in the axial direction Da. The roller of the first horizontal contact part 370B can contact the column part 75 from the width direction Dw. The first horizontal contact part 370B is fixed to the coupling member 320 at an interval in the axial direction Da. In this case, a first horizontal fixed position P715 serves as the column part 75.

The first vertical contact part 380B of the third modified example includes a roller that is rotatable about a shaft extending in the width direction Dw. The roller of the first vertical contact part 380B can contact the column part 75 from the axial direction Da. The first vertical contact part 380B is fixed to the coupling member 320. In this case, a first vertical fixed position P716 serves as the column part 75.

According to such a positioning member 300D, the roller of the first horizontal contact part 370B is pressed against the column part 75 from the width direction Dw. As a result, the positioning member 300D cannot move close to the column part 75 in the width direction Dw with respect to the first support part 7. The roller of the first vertical contact part 380B is pressed against the column part 75 from the axial direction Da. As a result, the positioning member 300D cannot move close to the column part 75 in the axial direction Da with respect to the first support part 7. In this manner, also in the third modified example, the second support part 8 can be easily and reliably positioned with respect to the first support part 7 in the process S45 for positioning the second support part 8 with respect to the first support part 7.

The first horizontal contact part 370B and the first vertical contact part 380B are in contact with the column part 75 via the roller. Accordingly, even when the first horizontal contact part 370B and the first vertical contact part 380B move in the vertical direction Dv when coming into contact with the column part 75, the column part 75 is prevented from being damaged.

Fourth Modified Example

Figure 26:
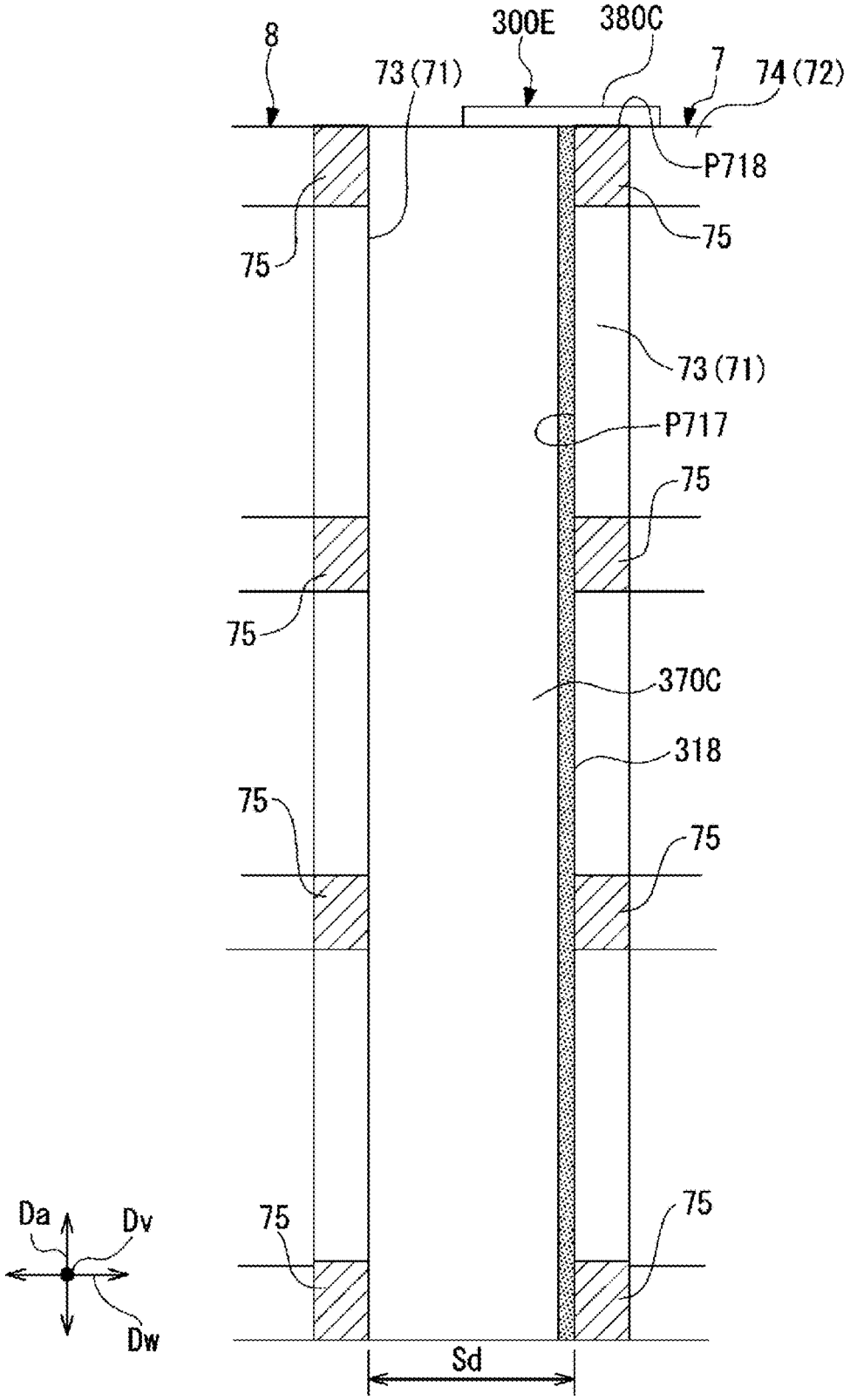
FIG. 26 is a plan view illustrating a positioning member according to a fourth modified example of the present embodiment.

The positioning member 300A is not limited to a member independent of the first support part 7 and the second support part 8. For example, as illustrated in FIG. 26, part of a positioning member 300E of the fourth modified example is formed as part of the second support part 8. Specifically, the positioning member 300E includes a first horizontal contact part 370C and a first vertical contact part 380C.

The first horizontal contact part 370C of the fourth modified example is formed integrally with the first lower vertical beam part 73 (first upper vertical beam part 71) of the second support part 8. The first horizontal contact part 370C has a structure in which the first lower vertical beam part 73 (the first upper vertical beam part 71) extend in the width direction Dw. In addition, the first horizontal contact part 370C includes a buffer material 318 made of a rubber-based material or the like on an end surface of the first horizontal contact part 370C close to the first support part 7 in the width direction Dw. The first horizontal contact part 370C is contactable with the first lower vertical beam part 73 (first upper vertical beam part 71) of the first support part 7 via the buffer material 318. In this case, a first horizontal fixed position P717 serves as the first lower vertical beam part 73 (the first upper vertical beam part 71).

In addition, the first vertical contact part 380C is disposed at a position not overlapping the first horizontal contact part 370C in the axial direction Da. The first vertical contact part 380C is a plate-shaped member connected to the first horizontal contact part 370C. The first vertical contact part 380C is fixed to an end surface of the first horizontal contact part 370C facing the axial direction Da. The first vertical contact part 380C extends so as to protrude from the first horizontal contact part 370C in the width direction Dw. The first vertical contact part 380C is contactable with the first lower horizontal beam part 74 (the first upper horizontal beam part 72) from the axial direction Da. In this case, a first vertical fixed position P718 serves as the first lower horizontal beam part 74 (the first upper horizontal beam part 72).

The first horizontal contact part 370C is in contact with the first lower vertical beam part 73 (the first upper vertical beam part 71) of the first support part 7 in this manner, and the positioning member 300E cannot thus move in the width direction Dw with respect to the first support part 7 so as to approach the first support part 7. The first vertical contact part 380C is in contact with the first lower horizontal beam part 74 (the first upper horizontal beam part 72) of the first support part 7, and the positioning member 300E cannot thus move toward the first support part 7 in the axial direction Da. In this manner, also in the fourth modified example, the second support part 8 can be easily and reliably positioned with respect to the first support part 7 in the process S45 for positioning the second support part 8 with respect to the first support part 7.

The first horizontal contact part 370C is in contact with the first lower vertical beam part 73 (the first upper vertical beam part 71) via the buffer material 318. Accordingly, even if the first horizontal contact part 370C moves in the vertical direction Dv when coming into contact with the first lower vertical beam part 73 (the first upper vertical beam part 71), the first lower vertical beam part 73 (the first upper vertical beam part 71) is prevented from being damaged.

Fifth Modified Example

According to the positioning member 300A of the above embodiment, the positioning member 300A is attached to the first support part 7 and the second support part 8. However, the structure of the positioning member 300A may be any structure as long as the interval between the first support part 7 and the second support part 8 in the width direction Dw can be matched with the installation interval Ld.

Figure 27:
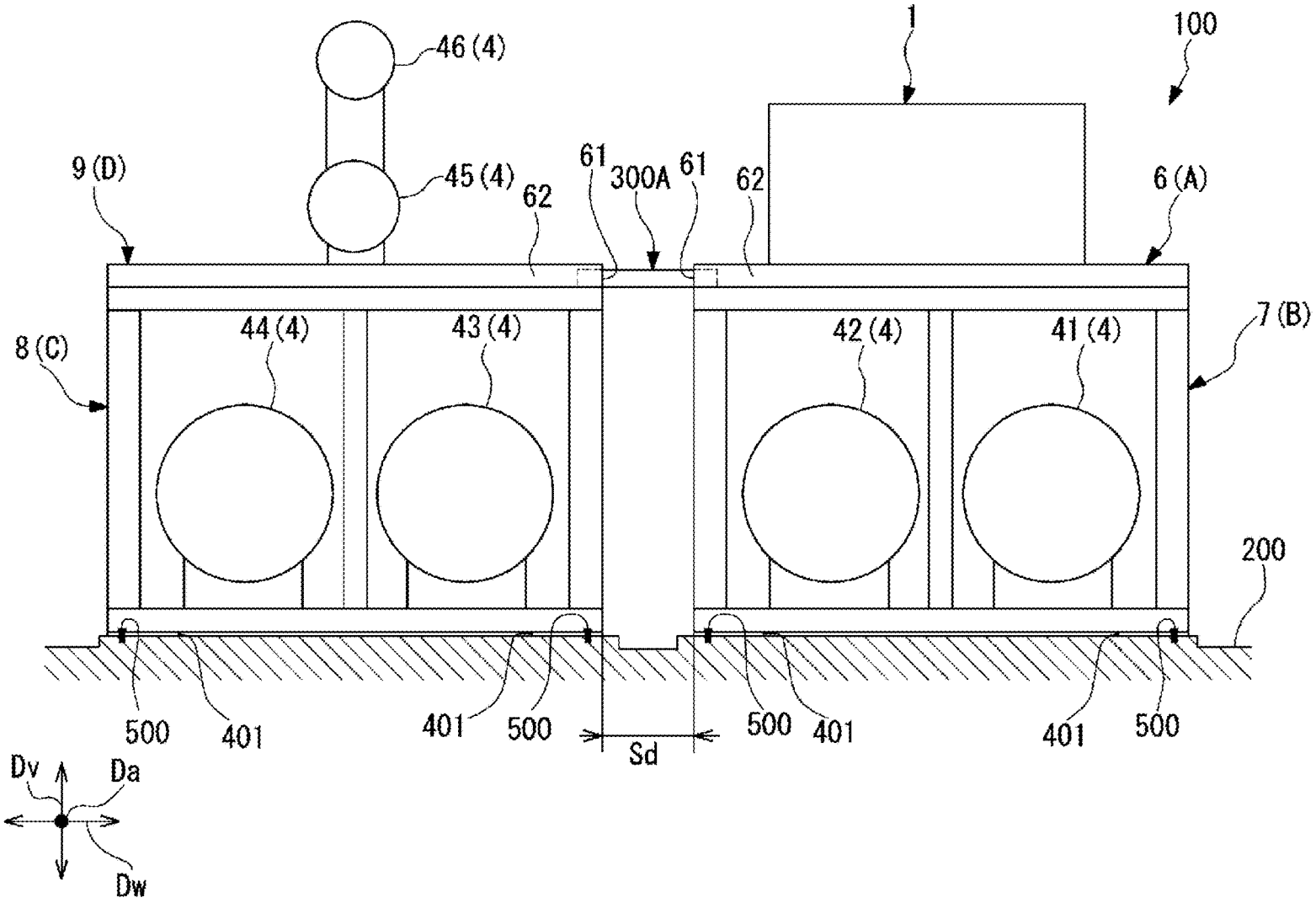
FIG. 27 is a diagram illustrating a position of a positioning member in a method for assembling a compressor module according to a fifth modified example of the present embodiment.

For example, as illustrated in FIG. 27, the positioning member 300A may be attached to the third support part 6 and the fourth support part 9, and the interval between the first support part 7 and the second support part 8 in the width direction Dw may be adjusted to the installation interval Ld. That is, the positioning member 300A may be disposed on the third support part 6 and the fourth support part 9. Specifically, one end of the first member 310 of the positioning member 300A is fixed to the third vertical beam part 61 of the fourth support part 9. The other end of the first member 310 is fixed to the third vertical beam part 61 of the third support part 6.

In addition, before the second support part 8 is installed on the installation surface 200, the third support part 6 is fixed to the first support part 7 installed on the installation surface 200. Specifically, the third unit A is fixed to the first unit B. Thereafter, the fourth support part 9 is fixed to the second unit C. At this time, the fourth unit D may be directly fixed to the second unit C, or the fifth cooling unit 45 and the sixth cooling unit 46 may be fixed after the fourth support part 9 is fixed. The positioning member 300A is fixed to the fourth support part 9 in a state where the third support part 6 is fixed to the first unit B and the fourth support part 9 is fixed to the second unit C.

Thereafter, suspending the second support part 8 and the fourth support part 9 with a crane or the like disposes the second support part 8 and the fourth support part 9 in a movable state spaced in the width direction Dw from the first support part 7. The second support part 8 and the fourth support 9 are moved, and the positioning member 300A fixed to the fourth support part 9 is fixed to the third support part 6. This allows, via the third support part 6 and the fourth support part 9, the positioning member 300A to complete positioning of the second support part 8 with respect to the first support part 7 on the installation surface 200 in the width direction Dw and the axial direction Da.

Such a configuration can also easily and reliably position the second support part 8 with respect to the first support part 7.

Supplementary Notes

The method S10 for assembling the compressor module 100 and the compressor module 100 described in the embodiments are understood as follows, for example.

(1) The method S10 for assembling the compressor module 100 according a first aspect is the method S10 for assembling the compressor module 100 including: the compressor 1 that includes the rotor shaft 1*a* rotating about the axis O and can compress a fluid in stages; the gas supply device 3 configured to supply a sealing gas to the compressor 1; the plurality of cooling units 4 configured to cool the fluid compressed by the compressor 1; the first support part 7 supporting at least two of the cooling units 4 from below in the vertical direction Dv and formed in a rectangular parallelepiped shape by the plurality of column parts 75 extending in the vertical direction Dv and the plurality of beam parts 71 and 73 extending in the first direction; the second support part 8 disposed spaced in the first direction from the first support part 7, supporting at least two of the cooling units 4 different from those supported by the first support part 7 from below in the vertical direction Dv, and formed in a rectangular parallelepiped shape by the plurality of column parts 75 extending in the vertical direction Dv and the plurality of beam parts 71 and 73 extending in the first direction; and the third support part 6 fixed directly above the first support part 7 in the vertical direction Dv and supporting the compressor 1 and the gas supply device 3 from below in the vertical direction Dv. The method S10 includes: the process S20 for preparing the positioning member 300A formed adjusted to the installation interval Sd in the first direction between the first support part 7 and the second support part 8 in a state where the first support part 7 and the second support part 8 are fixed on the installation surface 200; the process S35 for fixing, on the installation surface 200, the first support part 7 with the at least two of the cooling units 4 fixed; the process S43 for disposing the second support part 8 to which the at least two of the cooling units 4 different from those supported by the first support part 7 are being fixed in a movable state spaced in the first direction from the first support part 7; the process S45 for adjusting the interval between the first support part 7 and the second support part 8 in the first direction to the installation interval Sd by using the positioning member 300A and positioning the second support part 8 with respect to the first support part 7 on the installation surface 200 in a second direction orthogonal to the first direction and the vertical direction Dv and in the first direction; and the process S49 for fixing the second support part 8 on the installation surface 200.

According to the method S10 for assembling the compressor module 100, the positioning member 300A formed adjusted to the installation interval Ld between the first support part 7 and the second support part 8 in the width direction Dw is prepared in advance. Then, after the first support part 7 is fixed on the installation surface 200, the second support part 8 is disposed in a movable state spaced in the first direction from the first support part 7. Thereafter, the second support part is positioned with the interval of the second support part 8 in the width direction Dw with respect to the first support part 7 adjusted to the installation interval by the positioning member 300A and is fixed on the installation surface 200. Accordingly, the interval between the first support part 7 and the second support part 8 in the first direction can be fixed on the installation surface 200 in accordance with the installation interval with high accuracy. Therefore, the first support part 7 and the second support part 8 can be easily installed with high accuracy by the positioning member 300A without performing fine position adjustment on the installation surface 200. As a result, the compressor module 100 can be efficiently assembled with high accuracy.

(2) The method S10 for assembling the compressor module 100 according to a second aspect is the method S10 for assembling the compressor module 100 of (1) further including the process S41 for fixing, before the process S43 for disposing the second support part 8 movable with respect to the first support part 7, the positioning member 300A to the second support part 8 to which the at least two of the cooling units 4 different from those supported by the first support part 7 are being fixed.

In such a configuration, before the second support part 8 is disposed while being movable with respect to the first support part 7, the positioning member 300A is fixed to the second support part 8. That is, the second support part 8 and the positioning member 300A are being integrally movable. Accordingly, the interval between the first support part 7 and the second support part 8 in the first direction can be adjusted to the installation interval by the positioning member 300A only by moving the second support part 8. Therefore, when the interval between the first support part 7 and the second support part 8 in the first direction is adjusted to the installation interval, it is possible to omit the labor of fixing the positioning member 300A to both the first support part 7 and the second support part 8 on the installation surface 200. This reduces the work on the installation surface 200, and the work for determining the positions of the first support part 7 and the second support part 8 can be efficiently performed.

(3) The method S10 for assembling the compressor module 100 according to a third aspect is the method S10 for assembling the compressor module 100 of (1) or (2), wherein the process S20 for preparing the positioning member 300A includes the process S21 for fixing the first support part 7 on the temporary installation surface 250 set at another location different from the installation surface 200, the process S22 for fixing the second support part 8 on the temporary installation surface 250 after positioning the second support part 8 with respect to the first support part 7 on the temporary installation surface 250, and the process S25 for forming the positioning member 300A by using, as the installation interval Sd, an interval in the first direction between the first support part 7 fixed on the temporary installation surface 250 and the second support part 8.

According to such a configuration, the positioning member 300A is formed with the interval in the width direction Dw between the first support part 7 and the second support part 8 fixed on the temporary installation surface 250 being the installation interval Sd. That is, the positioning member 300A can be formed based on the installation interval Sd which is the interval in the first direction between the first support part 7 and the second support part 8 whose relative positions are determined on the temporary installation surface 250. By fixing the first support part 7 and the second support part 8 on the installation surface 200 by using such a positioning member 300A, the interval in the first direction between the first support part 7 and the second support part 8 on the installation surface 200 can be easily adjusted to the installation interval Sd. That is, the relative positions of the first support part 7 and the second support part 8 determined on the temporary installation surface 250 can be reproduced on the installation surface 200 with high accuracy and efficiency. Accordingly, the first support part 7 and the second support part 8 can be easily installed on the installation surface 200 with high accuracy.

(4) The method S10 for assembling the compressor module 100 according to a fourth aspect is the method S10 for assembling the compressor module 100 of any one of (1) to (3), wherein the first support part 7 has the first fixed position P71 at which the positioning member 300A is held by at least one of the column part 75 or the beam part 71, 73, the positioning member 300A includes the first position determination part 317 that is disposed at a position overlapping the first fixed position P71 and is thus immovable in the first direction and the second direction with respect to the first support part 7, and in the process S45 for positioning the second support part 8 with respect to the first support part 7, the second support part 8 moves the first position determination part 317 to overlap the first fixed position P71.

In this way, the positioning member 300A can be easily positioned with respect to the first support part 7 via the positioning member 300A by simply moving the first fixed position P71 and the first position determination part 317 to overlap each other.

(5) The method S10 for assembling the compressor module 100 according to a fifth aspect is the method S10 for assembling the compressor module 100 of (4), wherein the first support part 7 includes the first support hole 79 formed at the first fixed position P71, the first position determination part 317 includes the first insertion hole 313 that is disposed at a position overlapping the first support hole 79 and communicates with the first support hole 79 in the vertical direction Dv when the first position determination part 317 is disposed on the first support part 7, and the first pin 350 insertable into the first insertion hole 313 and the first support hole 79, and in the process S45 for positioning the second support part 8 with respect to the first support part 7, the first pin 350 is inserted into the first insertion hole 313 and the first support hole 79 with positions of the first insertion hole 313 and the first support hole 79 overlapping each other.

According to such a configuration, the positioning of the positioning member 300A with respect to the first support part 7 in the first direction and the second direction can be performed at once using the first pin 350. In this way, the positioning member 300A can be easily disposed at accurate positions with respect to the first support part 7 by a simple operation of only inserting the first pin 350 into the first insertion hole 313 and the first support hole 79.

(6) The method S10 for assembling the compressor module 100 according to a sixth aspect is the method S10 for assembling the compressor module 100 according to (5), wherein the first pin 350 is a tapered pin having an outer diameter gradually decreasing from an upper side toward a lower side in the vertical direction Dv.

Therefore, even if the positions of the first insertion hole 313 and the first support hole 79 are slightly deviated from each other, the insertability of the first pin 350 can be guaranteed. Therefore, the first pin 350 can be stably inserted into the first insertion hole 313 and the first support hole 79. Accordingly, the positioning member 300A can be stably disposed at an accurate position with respect to the first support part 7 and the second support part 8.

(7) The method S10 for assembling the compressor module 100 according to a seventh aspect is the method S10 for assembling the compressor module 100 of (2), wherein the second support part 8 has the second fixed position P81 at which the positioning member 300A is held by at least one of the column part 75 or the beam part 71, 73, the positioning member 300A includes the second position determination part 315 that is disposed at a position overlapping the second fixed position P81 and is thus immovable in the width direction Dw and the axial direction Da with respect to the second support part 8, and the second support part 8 includes the second support hole 88 formed at the second fixed position P81, the second position determination part 315 includes the second insertion hole 312 that is disposed at a position overlapping the second support hole 88 and communicates with the second support hole 88 in the vertical direction Dv when the second position determination part 315 is disposed on the second support part 8, and the second pin 360 insertable into the second insertion hole 312 and the second support hole 88, and the process S41 for fixing the positioning member 300A to the second support part 8 includes fixing the positioning member 300A to the second support part 8 after the second pin 360 is inserted into the second insertion hole 312 and the second support hole 88 with positions of the second insertion hole 312 and the second support hole 88 overlapping each other.

This can simultaneously position the positioning member 300A with respect to the second support part 8 in the first direction and the second direction. In this way, the positioning member 300A can be easily disposed at accurate positions with respect to the second support part 8 by a simple operation of only inserting the second pin 360 into the second insertion hole 312 and the second support hole 88.

(8) The method S10 for assembling the compressor module 100 according to an eighth aspect is the method S10 for assembling the compressor module 100 according to any one of (1) to (7), wherein the positioning member 300A includes the plurality of first members 310 each having one end fixed to the second support part 8, extending in the width direction Dw, and disposed spaced in the axial direction Da, and the coupling member 320 configured to couple the plurality of first members 310 to each other.

Accordingly, the rigidity of the positioning member 300A can be improved. Therefore, even if the positioning member 300A comes into contact with the first support part 7 or the second support part 8, it is possible to suppress the deformation leading to degradation of the function for determining the relative positions. As a result, the second support part 8 can be stably positioned with respect to the first support part 7 with high accuracy.

(9) The method S10 for assembling the compressor module 100 according to a ninth aspect is the method S10 for assembling the compressor module 100 according to (3), further including: the process S26 for recording the first interval Sv1 in the vertical direction Dv between the first support part 7 fixed on the temporary installation surface 250 and the temporary installation surface 250 in the vertical direction Dv and the second interval Sv2 in the vertical direction Dv between the second support part 8 fixed on the temporary installation surface 250 and the temporary installation surface 250; the process S33 for adjusting an interval in the vertical direction Dv between the first support part 7 and the installation surface 200 to the first interval Sv1 before the process S35 for the fixing the first support part 7 on the installation surface 200; and the process S47 for adjusting an interval in the vertical direction Dv between the second support part 8 and the installation surface 200 to the second interval Sv2 before the process S49 for fixing the second support part 8 on the installation surface 200.

Accordingly, the first support part 7 and the second support part 8 installed on the installation surface 200 can be adjusted to the height of the first support part 7 and the second support part 8 in the vertical direction Dv in a state of being fixed on the temporary installation surface 250. That is, the positions of the first support part 7 and the second support part 8 in the vertical direction Dv determined on the temporary installation surface 250 can be reproduced on the installation surface 200 with high accuracy and efficiency. Accordingly, it is possible to omit work of finely adjusting the positions of the first support part 7 and the second support part 8 in the vertical direction Dv on the installation surface 200, and to easily install the first support part 7 and the second support part 8 with high accuracy.

(10) The compressor module 100 according to a tenth aspect includes: the compressor 1 that includes the rotor shaft 1*a* rotating about the axis O and can compress a fluid in stages; the gas supply device 3 configured to supply a sealing gas to the compressor 1; the plurality of cooling units 4 configured to cool the fluid compressed by the compressor 1; the first support part 7 supporting at least two of the cooling units 4 from below in the vertical direction Dv and formed in a rectangular parallelepiped shape by the plurality of column parts 75 extending in the vertical direction Dv and the plurality of beam parts 71 and 73 extending in the first direction; the second support part 8 disposed spaced in the first direction from the first support part 7, supporting at least two of the cooling units 4 different from those supported by the first support part 7 from below in the vertical direction Dv, and formed in a rectangular parallelepiped shape by the plurality of column parts 75 extending in the vertical direction Dv and the plurality of beam parts 71 and 73 extending in the first direction; the third support part 6 fixed directly above the first support part 7 in the vertical direction Dv and supporting the compressor 1 and the gas supply device 3 from below in the vertical direction Dv; and the positioning member 300A that is formed adjusted to the installation interval Sd in the first direction between the first support part 7 and the second support part 8 with the first support part 7 and the second support part 8 fixed on the installation surface 200 and is configured to determine relative positions of the second support part 8 and the first support part 7 in a second direction orthogonal to the first direction and the vertical direction Dv and in the first direction.

INDUSTRIAL APPLICABILITY

A method for assembling a compressor module and the compressor module according to the present disclosure allows the compressor module to be efficiently assembled with high accuracy.

REFERENCE SIGNS LIST

1 Compressor
1 a Rotor shaft
1*b* Gear casing
2 Rotary drive machine
2*a* Output shaft
3 Gas supply device
4 Cooling unit
5 Oil console device
6 Third Support Part
6*a* Third frame body
7 First support part
7*a* First upper frame body
7*b* First lower frame body
8 Second support part
9 Fourth support part
10 Compression unit
11 First compression unit
12 Second compression unit
13 Third compression unit
14 Fourth compression unit
15 Fifth compression unit
16 Sixth compression unit
17 Seventh compression unit
18 Eighth compression unit
25 Drive support part
31 Piping
40 Shell
41 First cooling unit
42 Second cooling unit
43 Third cooling unit
44 Fourth cooling unit
45 Fifth cooling unit
46 Sixth cooling unit
49 Expansion joint
61 Third vertical beam part
62 Third horizontal beam part
65 Base plate body
71 First upper vertical beam part (beam part)
72 First upper horizontal beam part
73 First lower vertical beam part (beam part)
74 First lower horizontal beam part
75 Column part
78 Beam bolt insertion hole
79 First support hole
88 Second support hole
100 Compressor module
200 Installation surface
250 Temporary installation surface
300A to 300E Positioning member
310, 310A First member
311 Member bolt insertion hole
312 Second insertion hole
313 First insertion hole
315 Second position determination part
317, 317A First position determination part
318 Buffer material
319 Third position determination part
320, 320B Coupling member
330 Bolts and nuts
350 First pin
360 Second pin
370, 370A, 370B, 370C First horizontal contact part
380, 380B, 380C First vertical contact part
400 Bolt
401 Shim
403 Height adjustment bolt
500 Anchor bolt
A Third unit
B First unit
C Second unit
D Fourth unit
Da Axial direction
Dv Vertical direction
Dw Width direction
O Axis
P71, P710 First fixed position
P711, P713, P715, P717 First horizontal fixed position
P712, P716, P718 First vertical fixed position
P81 Second fixed position
S10 Method for assembling compressor module
S20 Process for preparing positioning member
S21 Process for fixing first support part on temporary installation surface
S22 Process for fixing second support part on temporary installation surface
S23 Process for disposing third support part on first support part
S24 Process for disposing fourth support part on second support part
S25 Process for forming positioning member
S26 Process for recording dimension
S27 Process for disassembling compressor module
S30 Process for installing first support part on installation surface
S31 Process for determining position of first support part
S33 Process for adjusting interval between first support part and installation surface in vertical direction to first interval
S35 Process for fixing first support part on installation surface
S40 Process for installing second support part on installation surface
S41 Process for fixing positioning member to second support part
S43 Process for disposing second support part in movable state
S45 Process for positioning second support part
S47 Process for adjusting interval between second support part and installation surface in vertical direction to second interval
S49 Process for fixing second support part on installation surface
S50 Process for fixing third support part on first support part
S60 Process for fixing fourth support part on second support part
Ld Installation interval
Sd Temporary installation interval
Sv1 First interval
Sv2 Second interval Sv3 Third interval
Sv4 Fourth interval

The invention claimed is:

1. A method for assembling a compressor module comprising: a compressor that includes a rotor shaft rotating about an axis and can compress a fluid in stages; a gas supply device configured to supply a sealing gas to the compressor; a plurality of cooling units configured to cool the fluid compressed by the compressor; a first support part supporting at least two of the cooling units from below in a vertical direction and formed in a rectangular parallelepiped shape by a plurality of column parts extending in the vertical direction and a plurality of beam parts extending in a first direction that is one of horizontal directions; a second support part disposed spaced in the first direction from the first support part, supporting at least two of the cooling units different from those supported by the first support part from below in the vertical direction, and formed in a rectangular parallelepiped shape by the plurality of column parts extending in the vertical direction and the plurality of beam parts extending in the first direction; and a third support part fixed directly above the first support part in the vertical direction and supporting the compressor and the gas supply device from below in the vertical direction, the method comprising:

preparing a positioning member formed adjusted to an installation interval in the first direction between the first support part and the second support part in a state where the first support part and the second support part are fixed on an installation surface;

fixing, on the installation surface, the first support part with the at least two of the cooling units fixed;

disposing the second support part to which the at least two of the cooling units different from those supported by the first support part are being fixed in a movable state spaced in the first direction from the first support part;

adjusting an interval between the first support part and the second support part in the first direction to the installation interval by using the positioning member and positioning the second support part with respect to the first support part on the installation surface in a second direction orthogonal to the first direction and the vertical direction and in the first direction, and fixing the second support part on the installation surface.

2. The method for assembling a compressor module according to claim 1 further comprising fixing, before the step of disposing the second support part movable with respect to the first support part, the positioning member to the second support part to which the at least two of the cooling units different from those supported by the first support part are being fixed.

3. The method for assembling a compressor module according to claim 1, wherein the step of preparing the positioning member includes fixing the first support part on a temporary installation surface set at another location different from the installation surface, fixing the second support part on the temporary installation surface after positioning the second support part with respect to the first support part on the temporary installation surface, and forming the positioning member by using, as the installation interval, an interval in the first direction between the first support part and the second support part fixed on the temporary installation surface.

4. The method for assembling a compressor module according to claim 1, wherein the first support part has a first fixed position at which the positioning member is held by at least one of the column part or the beam part, the positioning member comprises a first position determination part that is disposed at a position overlapping the first fixed position and is thus immovable in the first direction and the second direction with respect to the first support part, and in the step of positioning the second support part with respect to the first support part the second support part moves the first position determination part to overlap the first fixed position.

5. The method for assembling a compressor module according to claim 4, wherein the first support part comprises a first support hole formed at the first fixed position, the first position determination part comprises a first insertion hole that is disposed at a position overlapping the first support hole and communicates with the first support hole in the vertical direction when the first position determination part is disposed on the first support part and a first pin insertable into the first insertion hole and the first support hole, and in the step of positioning the second support part with respect to the first support part, the first pin is inserted into the first insertion hole and the first support hole with positions of the first insertion hole and the first support hole overlapping each other.

6. The method for assembling a compressor module according to claim 5, wherein the first pin is a tapered pin having an outer diameter gradually decreasing from an upper side toward a lower side in the vertical direction.

7. The method for assembling a compressor module according to claim 2, wherein the second support part has a second fixed position at which the positioning member is held by at least one of the column part or the beam part, the positioning member comprises a second position determination part that is disposed at a position overlapping the second fixed position and is thus immovable in the first direction and the second direction with respect to the second support part, and the second support part comprises a second support hole formed at the second fixed position, the second position determination part comprises a second insertion hole that is disposed at a position overlapping the second support hole and communicates with the second support hole in the vertical direction when the second position determination part is disposed on the second support part, and a second pin insertable into the second insertion hole and the second support hole, and the step of fixing the positioning member to the second support part comprises fixing the positioning member to the second support part after the second pin is inserted into the second insertion hole and the second support hole with positions of the second insertion hole and the second support hole overlapping each other.

8. The method for assembling a compressor module according to claim 1, wherein the positioning member comprises a plurality of first members each having one end fixed to the second support part, extending in the first direction, and disposed spaced in the second direction and a coupling member configured to couple the plurality of first members to each other.

9. The method for assembling a compressor module according to claim 3, further comprising:

recording a first interval in the vertical direction between the first support part fixed on the temporary installation surface and the temporary installation surface and a second interval in the vertical direction between the second support part fixed on the temporary installation surface and the temporary installation surface;

adjusting an interval in the vertical direction between the first support part and the installation surface to the first interval before the step of fixing the first support part on the installation surface; and adjusting an interval in the vertical direction between the second support part and the installation surface to the second interval before the step of fixing the second support part on the installation surface.

10. A compressor module, comprising:

a compressor that includes a rotor shaft rotating about an axis and can compress a fluid in stages;

a gas supply device configured to supply a sealing gas to the compressor;

a plurality of cooling units configured to cool the fluid compressed by the compressor;

a first support part supporting at least two of the cooling units from below in a vertical direction and formed in a rectangular parallelepiped shape by a plurality of column parts extending in the vertical direction and a plurality of beam parts extending in a first direction that is one of horizontal directions;

a second support part disposed spaced in the first direction from the first support part, supporting at least two of the cooling units different from those supported by the first support part from below in the vertical direction, and formed in a rectangular parallelepiped shape by a plurality of column parts extending in the vertical direction and a plurality of beam parts extending in the first direction;

a third support part fixed directly above the first support part in the vertical direction and supporting the compressor and the gas supply device from below in the vertical direction; and a positioning member that is formed adjusted to an installation interval in the first direction between the first support part and the second support part with the first support part and the second support part fixed on an installation surface and is configured to determine relative positions of the second support part and the first support part in a second direction orthogonal to the first direction and the vertical direction and in the first direction.

* * * * *